US006101363A

United States Patent [19]

Tomatsu

[11] Patent Number: 6,101,363

[45] Date of Patent: Aug. 8, 2000

[54] THERMAL FIXING DEVICE WITH STATIONARY AND ROTATIONAL ELECTRODES

[75] Inventor: Yoshiya Tomatsu, Nagoya, Japan

[73] Assignee: Brother Kogyo Kabushiki Kaisha, Nagoya, Japan

[21] Appl. No.: 09/220,701

[22] Filed: Dec. 24, 1998

[30] Foreign Application Priority Data

Dec. 24, 1997 [JP] Japan ..... 9-354997
Mar. 30, 1998 [JP] Japan ..... 10-083855

[51] Int. Cl.[7] ..... G03G 15/20; H05B 3/16

[52] U.S. Cl. ..... 399/330; 219/216; 219/469

[58] Field of Search ..... 399/330, 328, 399/331, 333, 334; 219/216, 469, 470, 471

[56] References Cited

U.S. PATENT DOCUMENTS 5,575,942 11/1996 Watanabe ..... 219/469
5,729,814 3/1998 Suzuki et al. ..... 399/333
5,826,152 10/1998 Suzuki et al. ..... 399/330
5,958,269 9/1999 Suzuki et al. ..... 219/216

FOREIGN PATENT DOCUMENTS 8-194401 7/1996 Japan .
8-314309 11/1996 Japan .
9-138605 5/1997 Japan .
9-179423 7/1997 Japan .

*Primary Examiner*—Richard Moses
*Attorney, Agent, or Firm*—Oliff & Berridge, PLC

[57] ABSTRACT

A collector plate 74*a*, which serves as a contact surface of a rotational electrode member 71, is disposed to intersect an imaginary rotational axis RA of a thermal roller 10. The stationary electrode member 72 can be brought into contact with the collector plate 74*a* at a position near the rotational center of the collector plate 74*a*. As a result, friction between the two electrode members can be suppressed so that the electrode members do not wear out as quickly. Defective contact or damage of electrode members can be reduced.

22 Claims, 16 Drawing Sheets

THERMAL FIXING DEVICE WITH STATIONARY AND ROTATIONAL ELECTRODES

BACKGROUND OF THE INVENTION

1. Field of the Invention

The present invention relates to a fixing device for, after an image is formed on a recording medium from a thermally meltable recording material, fixing the image onto the recording medium by heating the recording medium.

2. Description of the Related Art

Conventionally, there have been image forming devices such as copy machines, printers, and facsimile machines that form images on a recording medium. One type of image forming device impinges a thermally meltable recording material onto a recording medium to form an image on the recording medium from the thermally meltable recording material. This type of image forming device normally includes a fixing device that heats the recording medium to melt or soften the recording material on the recording medium and to fix the recording material onto the recording medium. For example, an electrophotographic image forming device, such as a laser printer, uses toner as the thermally meltable recording material. The fixing device heats the recording medium to melt or soften the toner melt and fix the toner onto the recording medium.

Japanese Patent-Application Publication (Kokai) No. HEI-8-314309 discloses a fixing unit used in this type of image forming device. The fixing unit includes a thermal roller and a pressing roller. The thermal roller is formed from a metal tube and a sheet-shaped heating element fixed to the inner surface of the metal tube. The heating element heats up the metal tube. The heat from the metal tube is applied to a recording medium sandwiched between the thermal roller and the pressing roller. The recording medium is heated up as a result.

In order to supply power to the sheet-shaped thermal body, even though it rotates with rotation of the thermal roller, sliding contact mechanisms for supplying power to the sheet-shaped thermal body are provided at either end of the thermal roller. Each sliding contact mechanism includes a rotational electrode member that rotates integrally with the thermal roller, and a stationary electrode member disposed in contact with the rotational electrode member. The rotational electrode member is formed from a metal tube mounted on the corresponding end of the thermal roller. The stationary electrode member is formed from a metal rib supported on a casing of the image forming device, in contact with the outer peripheral surface of the corresponding metal tube. With this configuration, electrical connection between the rotational and stationary electrode members can be maintained even while the thermal roller is rotating.

SUMMARY OF THE INVENTION

However, friction is generated where the rotational and stationary electrode members contact each other. As a result, the rotational and stationary electrode members wear down where they contact each other. When wear becomes excessive, the electrode members can be damaged and contact between the electrode members can become defective. Such problems can be prevented by frequent inspection and replacement of the electrode members. However, this solution requires a great deal of labor for preventative maintenance. For this reason, with this type of sliding contact mechanism, it becomes important to reduce wear by friction even if only by a small amount.

Further, it can be difficult to properly maintain electrical connection between electrode members of a sliding contact mechanism. For example, the surface of the rotating electrode member can become partially covered with an electrically insulating material, such as dirt or other such foreign material, or oxidized portions at the surface of the rotational electrode member. In this case, the electrically insulating material is cyclically moved in between the rotational electrode member and the stationary electrode member by rotation of the rotational member. Electric connection between the rotational electrode member and the stationary electrode member is interrupted each time rotation of the rotational electrode member interposes the electrically insulating material between the two electrode members.

Also, when the stationary electrode member is vibrated for some reason, the stationary contact member can separate from the rotational electrode member instantaneously with the vibration. When the stationary contact member separates from the rotational electrode member in this manner, electrical connection between the electrode members is interrupted.

In this way, electric supply can become unstable when the fixing device is poorly maintained. When electric supply is unstable, the thermal roller may take a long time to sufficiently heat up, or worse yet the thermal roller may become incapable of heating up sufficiently for image fixing operations.

It is an objective of the present invention to overcome the above-described problems and to control friction related wear of electrode members in a sliding contact mechanism for supplying power to a heating body fixed in a roller of a fixing device.

A fixing device according to the present invention is for heating a recording material on a recording medium to fix the recording material onto the recording medium. To achieve the above-described objectives, the fixing device includes a roller, a heating body, and sliding contact mechanism with the following configuration. The roller is rotatably supported about an imaginary rotational axis. The heating body is fixed on the roller and is heated up when energized with electric power.

The sliding contact point mechanism is for supplying power to the heating body for energizing the heating body. The sliding contact point mechanism includes a rotational electrode member and a stationary electrode member. The rotational electrode member is fixed to the roller so as to rotate integrally with the roller. The rotational electrode member has a contact surface that intersects the imaginary rotational axis of the roller. The stationary electrode member is disposed in sliding contact with the contact surface of the rotational electrode member.

Several benefits are derived because the contact surface of the rotational electrode member intersects the imaginary rotational axis of the roller. With this configuration, the stationary electrode member can be brought into contact with the contact surface near the rotational center of the contact surface. As a result, the stationary electrode member slides against the rotational electrode member at a slower speed and across a shorter distance than the stationary electrode member of the sliding contact mechanism disclosed in Japanese Laid-Open Patent Application Kokai No. HEI-8-314309, wherein the stationary electrode member contacts the outer peripheral surface of a cylindrical shaped rotational electrode member. Wear of the electrode members by friction can be suppressed by this reduction in slide speed and distance. Accordingly, problems such as defective contact and damaged electrode members are less likely to occur compared with conventional fixing devices. Also, less labor is required for maintenance, such as inspection and replacement of the electrode members. Further, only a small friction force is generated between the stationary and rotational electrode members. Therefore, only a small burden is placed on the drive system for rotating the thermal roller. Further, only a small amount of noise is generated by this friction compared to conventional products so that the laser printer runs quieter during operation. That is, the noise and vibration produced at the contact points can be suppressed by the amount that the sliding speed and distance of the contact points is reduced.

It should be noted that the sliding contact mechanism forms a portion of a power supply route over which power is supplied to the thermal body. Therefore, at least two sliding contact mechanism, that is, two sets of rotational and stationary electrode members, must be provided to serve as the terminals of the thermal body. It is conceivable that the thermal body has three or even more energizing terminals. In this case, sliding contact mechanisms can be provided in the same number as the energizing terminals. Although the best effects are achieved when both of the sliding contact mechanisms have the above-described configuration, good effects can be achieved even if only one of the sliding contact mechanisms has the above-described configuration. That is, one of the sliding contact mechanisms can have a conventional configuration.

The rotational and stationary electrode members can be formed from an optionally selected conductive material, such as a metal, used generally as a material for forming contact points. It is desirable that the conductive material be one with excellent abrasion resistance. It is also desirable that the surfaces where the electrode members contact each other have a low electric resistance.

Also, in order to maintain stable contact between both electrode members, the sliding contact mechanism can be configured so that one of the electrode members is urged against the other electrode member. For example, the sliding contact mechanism can be configured so that the stationary electrode member presses against the contact surface of the rotational electrode member. To accomplish this, the stationary electrode member can be formed in a plate spring shape so that resilient deformation of the stationary electrode member itself presses the stationary electrode member against the rotational electrode member. Alternatively, the stationary electrode member can be configured from separate spring and conductive portions, wherein the conductive portion is fixed to the end of the spring portion and serves as an electrode pressed against the rotational electrode member by resilient deformation of the spring portion. With the later configuration, the conductive portion and the spring member can be formed from different materials that best suit their functions. For example, the conductive portion can be formed from an excellent electrical conductor and the spring member can be formed from a material with excellent resiliency.

Well-known configurations can be optionally utilized for driving the roller and the thermal body to rotated integrally with each other. For example, normally the roller of a conventional fixing device is a tube or cylinder made from a material with excellent heat conduction. Therefore, metals, especially aluminum, are suitable as materials for forming the roller because of their good heat conduction. Further, it is desirable that the roller be formed from a "no-stick" material that resists clinging of heated and melted recording material to its outer surface. For example, a fluorocarbon resin can be coated on the outer peripheral surface of the roller.

The thermal body can be anything that can be fixed to the roller and that is capable of sufficiently heating the roller. For example, the thermal body can be a sheet-shaped thermal body fixable to the inner or outer peripheral surface of the roller. When the roller is formed from a conductive material, then some sort of electrical insulation material must be disposed between the roller and the thermal body because the thermal body is heated by having an electric current passed through it. When the thermal body is disposed on the outer peripheral surface of the roller, then it is desirable that some measure be taken to prevent electric shocks and unexpected short circuits. For example, electrical insulation material could be provided to cover the outer peripheral surface of the thermal body.

According to another aspect of the present invention, the stationary electrode member is disposed to contact the rotational electrode member at the substantial rotational center of the contact surface. Said differently, the stationary electrode member contacts the contact surface of the rotational electrode member at substantially where the contact surface intersects with the imaginary rotational axis of the roller.

With this configuration, the sliding speed and sliding distance of the stationary electrode member against the rotational electrode member is virtually zero, so that wear of the electrode members can be greatly suppressed.

According to another aspect of the present invention, the contact surface of the rotational electrode member is oriented substantially perpendicular with the imaginary rotational axis of the roller. With this configuration, the orientation of the contact surface will not fluctuate when the rotational electrode member rotates. For this reason, the rotational electrode member and the stationary electrode member can be maintained reliably in contact with each other at a substantially fixed and stable contact pressure, without the stationary electrode member or the contact point moving along the rotational axis of the roller. Therefore, the thermal body can be even more reliably energized.

According to another aspect of the present invention, the stationary electrode member includes at least two contact points in electrical connection with the rotational electrode member at different positions.

With this configuration, even if electrical connection at one of the contact points is interrupted, the thermal body can still be reliably energized through electrical connection at the other contact point or points.

As a result, electrical connection between the electrode members is properly maintained at least by one contact point. Accordingly, supply of electric power is stable and the thermal roller can be heated in a short amount of time.

The at least two contact points can be arranged on the stationary electrode member so that when the rotational electrode member rotates, the at least two contact points define, or draw, different orbits on the contact surface of the rotating rotational electrode member. With this configuration, the plurality of electrode points will not wear down the same positions on the surface of the rotational electrode members. Localized wear of the rotational electrode member can be minimized. Accordingly, the life span of the rotational electrode member will be no shorter than when the stationary electrode member is provided with only a single contact point.

The stationary electrode member can be provided with a single support member for supporting the at least two contact points. Alternatively, the stationary electrode member can be provided with more than one support body, wherein one or more contact point is disposed on each support body.

The at least two contact points can be configured from conductive protrusions formed on the same imaginary circle on the stationary electrode member, wherein the center of the imaginary circle does not overlap the imaginary rotational axis of the roller. Because the conductive protrusions are formed on the same imaginary circle, the conductive protrusions uniformly contact the contact surface of the rotational electrode member. Moreover, because the center of the imaginary circle does not overlap the rotational center of the rotational electrode member, even though the conductive protrusions are disposed on the surface of the circle, the conductive protrusions will not delineate, that is, draw, the same orbit on the rotating rotational electrode member. Therefore, the contact surface, that is, the terminal of the rotational electrode member will not be worn down at certain places more than others.

It should be noted that a fixing device having any of the above-described configurations can be used in an image forming device that uses thermally meltable recording material to form images on a recording medium, such as paper. Such an image forming device is provided with an image forming mechanism for forming images on the recording medium by impinging the thermally meltable recording material onto the recording medium. In this case, the fixing device is for fixing the recording material onto the recording medium by heating the recording medium to melt or soften the recording material.

Examples of such an image forming device include copy machines, printers, and facsimile machines. The image forming mechanism could be an electrophotographic image forming mechanism, which includes: an electrophotographic photosensitive drum; a laser light source or LED array for irradiating the surface of the photosensitive drum to produce an electrostatic latent image on the surface of the photosensitive drum; a development unit for developing the electrostatic latent image into a visible image using toner, which serves as a thermally meltable recording material; and a transfer unit for transferring the visible toner image onto the paper sheet or other recording medium.

The image forming mechanism could alternatively be an electrostatic recording type image forming device, wherein the recording medium is an electrostatic recording sheet coated with a dielectric material. With such a device, an electrostatic latent image is formed on the electrostatic recording sheet and toner is used to develop the electrostatic latent image.

The image forming mechanism could alternatively be a hot-melt-type ink-jet image forming mechanism. Hot melt ink is solid at room temperature and melted into a liquid by application of heat. A hot-melt-type ink-jet image forming mechanism melts the hot melt ink and ejects it from a recording head to form an image on a recording medium.

It is desirable that a resilient body be provided for pressing the one or more conductive protrusions into contact with the rotational electrode member. One or more resilient bodies can be provided for pressing the conductive protrusions against the rotational electrode member at two or more separate contact positions.

When a single resilient body is provided with more than one conductive protrusion for pressing against rotational electrode member at two or more different positions, the stationary electrode member resiliently presses into contact with the rotational electrode member. When a single resilient body is provided with more than one conductive protrusion, it is desirable that the pressing force of the resilient body be dispersed evenly between the more than one conductive protrusions. With this configuration, even if only a single resilient body is provided, pressure force will not be concentrated at a single conductive protrusion. Therefore, contact condition will be stable at all the conductive protrusions. Further, because more contact points are provided than resilient bodies, the configuration can be more compact than if the same number of contact points are provided as the resilient bodies.

When two or more resilient bodies are provided, each resilient body can be configured to press a single conductive protrusion against the rotational electrode member at a single contact position. In this way, resilient bodies in total will press a plurality of conductive protrusions against the rotational electrode member at a total of two or more contact positions. Alternatively, each resilient body can be configured to press a plurality of conductive protrusions against the rotational electrode member at two or more contacts positions.

When each of a plurality of resilient bodies is each provided with a separate conductive protrusion for pressing against the rotational electrode member, even if one of the resilient bodies should operate to apply pressure for interrupting proper contact between its conductive protrusion and the rotational electrode member, the remaining resilient body or bodies will not be affected so that proper contact between the conductive protrusions and the rotational electrode members can be maintained.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
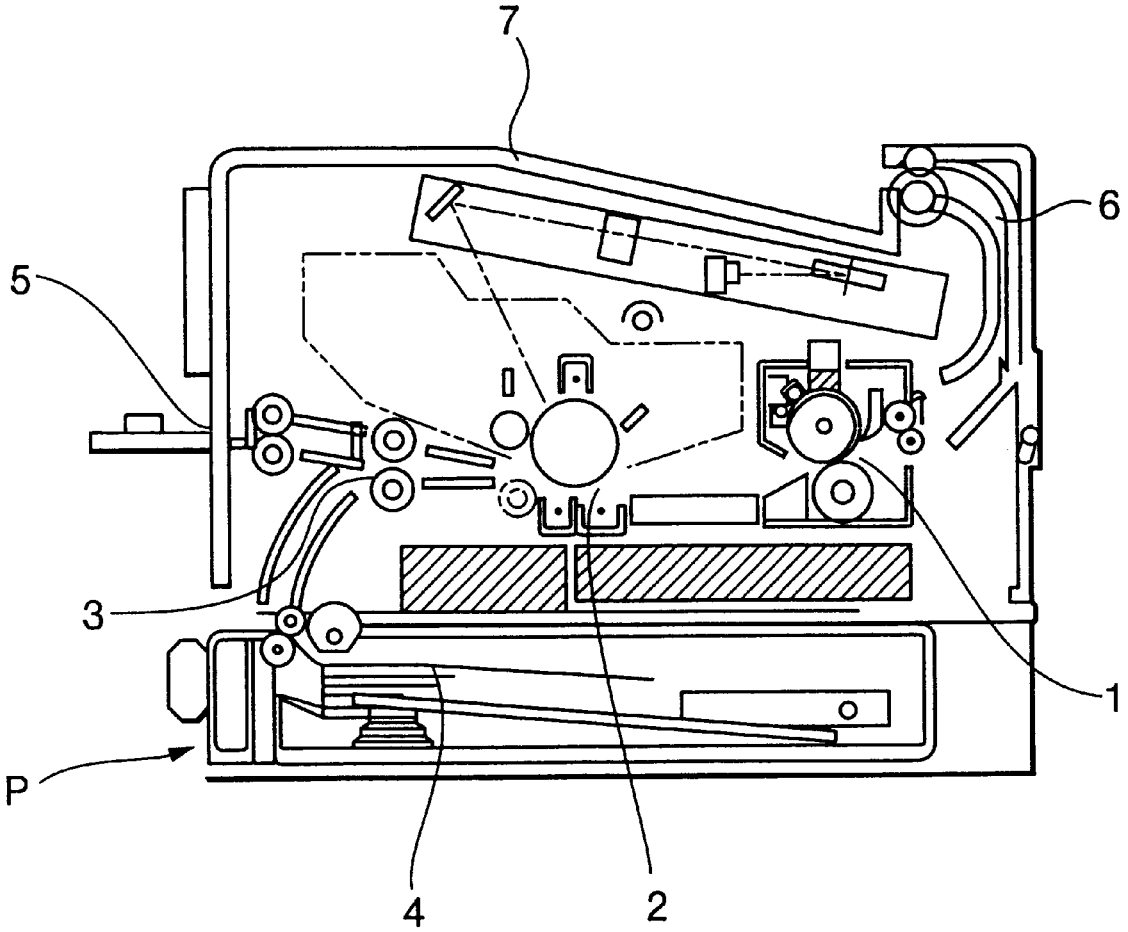
FIG. 1 is a cross-sectional view schematically showing a laser printing including a fixing device according to the present invention.

A laser printer P including a fixing device 1 according to embodiments of the present invention will be described while referring to the accompanying drawings wherein like parts and components are designated by the same reference numerals to avoid duplicating description.

As shown in FIG. 1, the laser printer P includes the fixing device 1, an image forming mechanism 2, a sheet supply mechanism 3, a sheet discharge mechanism 6, and other components, all housed within a casing 7.

The sheet supply mechanism 3 is disposed upstream from the image forming mechanism 2 in a sheet feed direction. The sheet supply mechanism 3 includes a sheet supply cassette 4 filled with a stack of sheets, a manual sheet supply portion 5 capable of supplying one sheet at a time, and rollers for taking up sheets from the sheet supply cassette 4 or the manual sheet supply portion 5, and supplying the sheets to the image forming mechanism 2. With this configuration, the rollers are driven to rotate to take up a sheet from either of the sheet supply cassette 4 or the manual sheet supply portion 5. While the sheet is sandwiched between the rollers, rotation of the rollers transports the sheet downstream in the sheet transport direction toward the image forming mechanism 2

The image forming mechanism 2 is for forming images from toner on a paper sheet, which serves as a recording medium. The image forming mechanism 2 is an electrophotographic image forming device and includes a well-known electrophotographic photosensitive drum, a charging unit, an exposure unit including a laser light source, a developing unit, a transfer unit, and a charge removing unit. To form a toner image on the surface of a sheet, the charging unit charges the surface of the electrophotographic photosensitive drum. The exposure unit irradiates the surface of the photosensitive drum with laser light to produce an electrostatic latent image on the surface of the photosensitive drum. The developing unit develops the electrostatic latent image into a visible toner image onto a paper sheet transported by the sheet supply mechanism 3 from downstream in the sheet transport direction.

The fixing device 1 is for transporting the sheet downstream from the image forming mechanism 2 in a sheet transport direction and, at the same time, heating the sheet to soften or melt the toner onto the sheet, thereby fixing the toner image onto the sheet. The fixing device 1 will be described in greater detail later.

The sheet discharge mechanism 6 is disposed downstream from the fixing device 1 in the sheet transport direction. The sheet discharge mechanism 6 transports a sheet on which the toner image is fixed by the fixing device 1 onto a tray at the top of the laser printer P.

Figure 2:
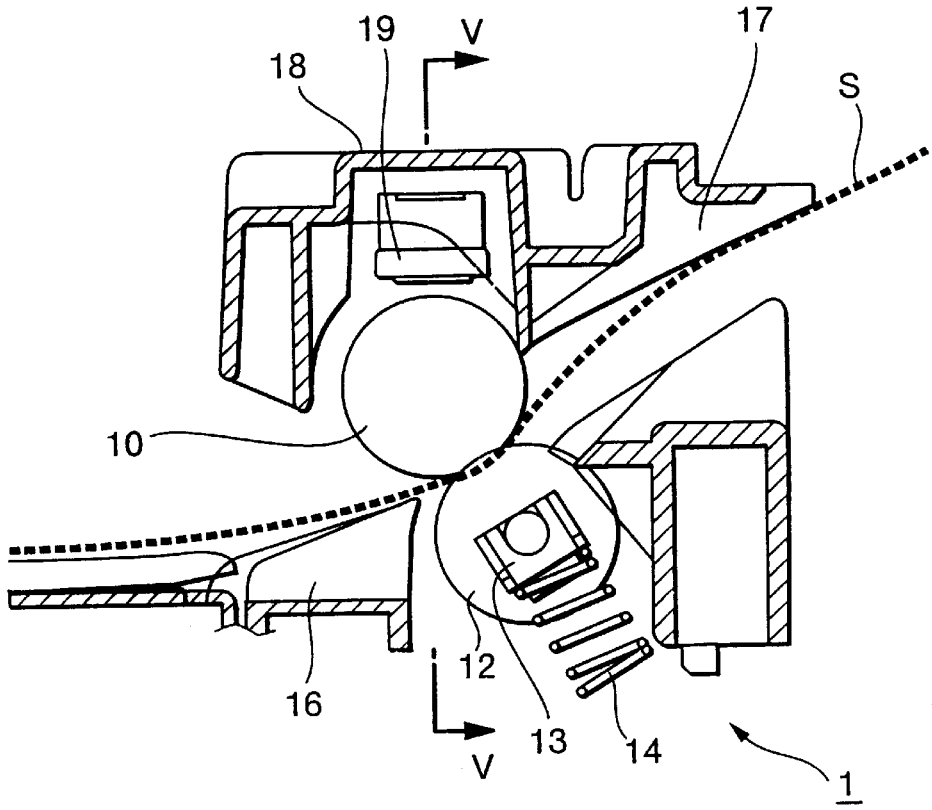
FIG. 2 is a magnified cross-sectional view showing essential components of the fixing device.

Next, a detailed description will be provided for the fixing device 1. The fixing device 1 is shown in more detail in FIG. 2. As shown in FIG. 2, the fixing device 1 includes a thermal roller 10 and pressure roller 12. As will be described in more detail later, the thermal roller 10 has a tubular aluminum base and a thermal body fixed to the inner surface of the aluminum tube base. The pressure roller 12 is formed from silicone rubber disposed around a metal shaft.

The thermal roller 10 and the pressure roller 12 are rotatably disposed in parallel alignment with each other. The pressure roller 12 is rotatably supported on a bearing 13, which is movable toward and away from the thermal roller 10. A spring 14 is provided for urging the bearing 13 in the direction toward the thermal roller 10. With this configuration, the pressure roller 12 and the thermal roller 10 are maintained with their outer peripheral surfaces in pressing contact.

Sheet guides 16, 17 are disposed adjacent to, and on opposite sides of, the thermal roller 10 and the pressure roller 12. When a sheet S is transported from the image forming mechanism 2, which is disposed upstream from the fixing device 1 in the sheet transport direction, the sheet guide 16 guides the sheet S to between where the thermal roller 10 and the pressure roller 12 press against each other. Rotation of the rollers 10, 11 draws the sheet S guided by the sheet guide 16 in between the thermal roller 10 and the pressure roller 1, and further transports the sheet S to the sheet guide 17. The sheet guide 17 in turn guides the sheet S to the sheet discharge mechanism 6, which is further downstream from the fixing device 1 in the sheet transport direction.

A temperature fuse 19 is mounted on an upper cover 18, which is disposed above the thermal roller 10. The temperature fuse 19 is disposed in confrontation with the outer peripheral surface of the thermal roller 10. If the thermal roller 10 generates an excess amount of heat due to, for example, run away operations of a control unit of the laser printer P, the temperature fuse 19 receives the unusually high temperature from the thermal roller 10, and breaks so that supply of power is interrupted. The temperature fuse 19 is of the type that, once blown after a predetermined excessive temperature is exceeded, can not be returned to a condition for transmitting current. However, the temperature fuse 19 can be replaced with a revertible switching thermostat capable of alternately connecting and breaking electrical connection depending on temperature condition. A revertible switching thermostat can prevent abnormally high temperatures from developing in the same manner as the temperature fuse 19.

Although not shown in the drawings, the fixing device 1 is provided with a temperature sensor in addition to the temperature fuse 19. The temperature sensor is for detecting surface temperature of the thermal roller 10. Temperature at the surface of the thermal roller 10 is constantly monitored using the temperature sensor, and control is performed accordingly to maintain the temperature at the surface of the thermal roller 10 at a suitable temperature.

Figure 3:
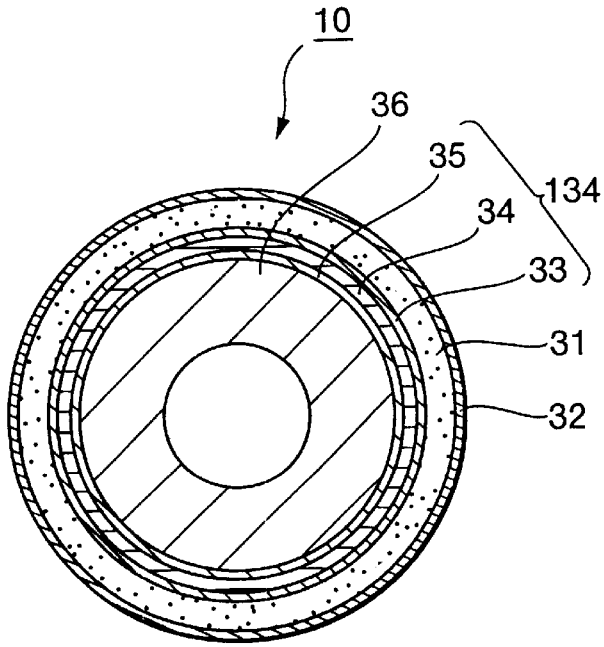
FIG. 3 is a cross-sectional view showing internal configuration of a thermal roller of the fixing device.

As shown in FIG. 3, the thermal roller 10 is formed from several concentric layers, including, from the outermost layer to the innermost layer, a clinging prevention layer 32, a roller body 31, a film member 134, and a pressure resilient body 36.

The clinging prevention layer 32 is formed onto the outer peripheral surface of the roller body 31 and is provided for preventing toner on the surface of the recording medium from clinging to the thermal roller 10 during fixing operations. The clinging prevention layer 32 can be formed by coating a fluorocarbon resin material to a thickness of about 10 to 30 $\mu$m on the outer peripheral surface of the roller body 31. The fluorocarbon resin material should have excellent heat resistance and separation properties.

The roller body 31 serves as a base of the thermal roller 10 and is formed from aluminum in a hollow tube shape.

The film member 134 is disposed at the interior of the roller body 31 and includes three layers: a first thermal resistant layer 33, a thermal layer 34, and a second thermal resistant layer 35 in this order from exterior to interior. The film member 134 is disposed to the exterior of the pressure resilient body 36 and so is supported by being sandwiched between the pressure resilient body 36 and the inner peripheral surface of the roller body 31.

Figure 4:
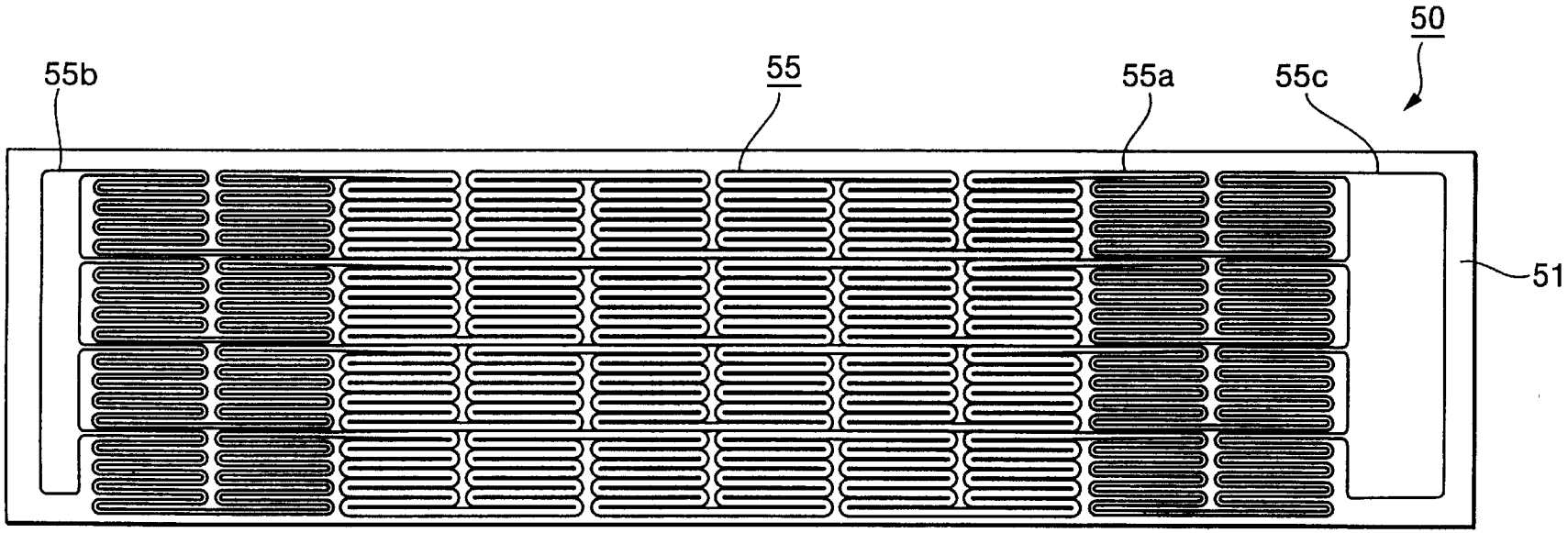
FIG. 4 is a plan view showing a sheet-shaped thermal body of the thermal roller.

The thermal layer 34 is formed from a sheet-shaped heating body 50 shown in FIG. 4. The sheet-shaped heating body 50 is a flexible sheet including an insulation base 51, which is formed from a polyimide resin film, and an electrical resistance-type heat generating layer 55. The thermal layer 34 is inserted into the roller body 31 so that the heat generating layer 55 faces, and is in contact with, the second thermal resistance layer 35.

The heat generating layer 55 is formed from a stainless steel foil layer and includes a heating pattern portion 55*a*, a first energization terminal 55*b* connected to one end of the heating pattern portion 55*a*, and a second energization terminal 55*c* connected to the other end of the heating pattern portion 55*a*. With this configuration, the heating pattern portion 55*a* heats up when current flows between the first energization terminal 55*b* and the second energization terminal 55*c*. The heating pattern portion 55*a* of the heat generating layer 55 can be formed by attaching stainless steel foil onto the insulation base 51 and then etching the stainless steel foil into a desired pattern.

Both of the thermal resistant layers 33, 35 are formed from a polyimide resin film having excellent heat resistance and that provides excellent electrical insulation. The first thermal resistant layer 33 is in confrontation with the insulation base 51 of the sheet-shaped heating body 50. As a result, the first thermal resistant layer 33 and the insulation base 51 form a double insulation layer for preventing electrical connection between the heat generating layer 55 and the roller body 31. With this configuration, if, for some reason the first thermal resistant layer 33 or the insulation base 51 becomes damaged, electrical connection between the roller body 31 and the heat generating layer 55 can still be prevented.

The second thermal resistant layer 35 prevents direct contact between the heat generating layer 55 and the pressure resilient body 36. It is conceivable that, for some reason, the heat generating layer 55 could generate an unusually high heat at certain portions thereof. However, even if the unusually hot portions of the resistant heater layer exceed the heat resistance temperature of the silicone sponge material of the pressure resilient body 36, the second thermal resistant layer 35 prevents the pressure resilient body 36 from being rapidly heated up to its combustion point. Therefore, fires and other such accidents can be prevented.

The pressure resilient body 36 is a hollow tube formed from silicone sponge. The pressure resilient body 36 is disposed to the interior of the film member 134. The outer diameter of the pressure resilient body 36 is larger when the pressure resilient body 36 is in an unstressed condition than when the pressure resilient body 36 is disposed in the thermal roller 10. To insert the pressure resilient body 36 into the thermal roller 10, the pressure resilient body 36 is stretched in its axial length. As a result, the outer diameter of the pressure resilient body 36 shrinks. After the pressure resilient body 36 is disposed inside the thermal roller 10, stretching of the pressure resilient body 36 is stopped. As a result, the pressure resilient body 36 shortens in its axial length to its original length and expands to its original outer diameter. Therefore, the pressure resilient body 36 presses against the film member 134, thereby sandwiching the film member 134 between the pressure resilient body 36 and the roller body 31.

Figure 5:
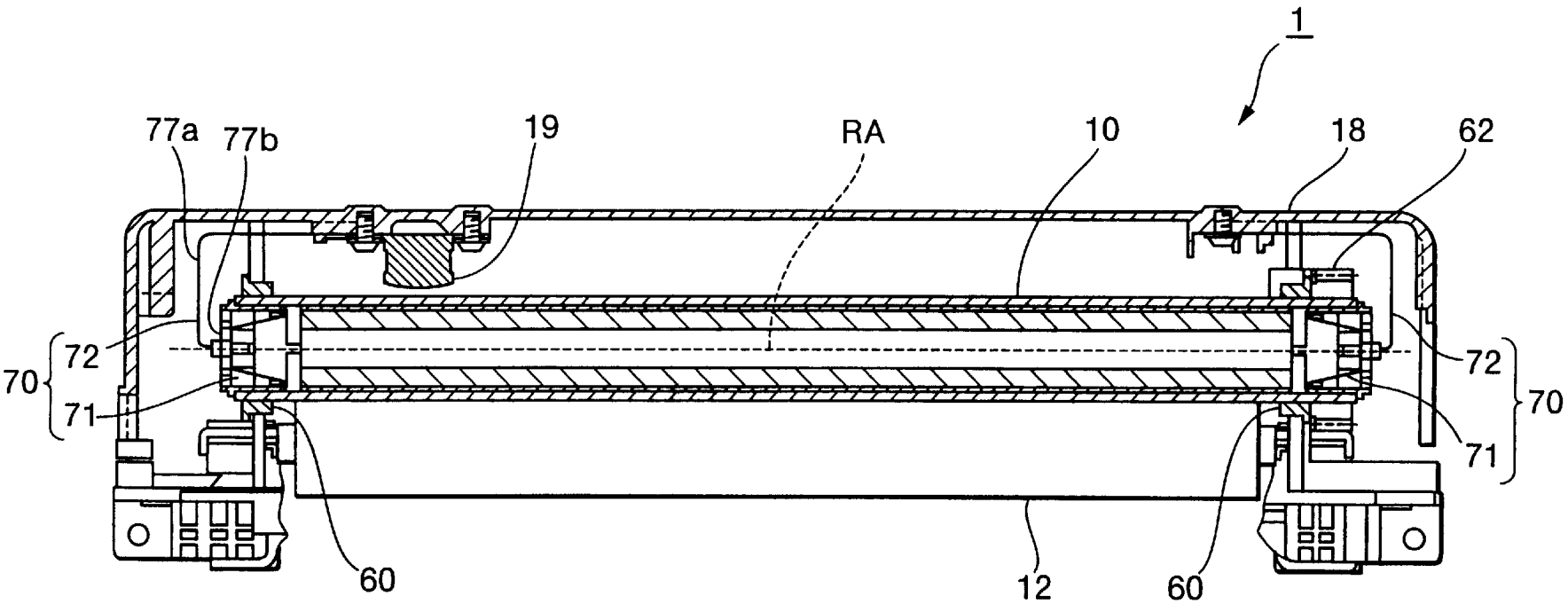
FIG. 5 is a cross-sectional view taken along line V—V of FIG. 2.

As shown in FIG. 5, the thermal roller 10 having the above-described configuration is rotatably supported on bearings 60, 60, which are fixed to the frame of the laser printer P. Also, a drive gear 62 is mounted on one tip of the thermal roller 10. In order to drive the thermal roller 10 to rotate, drive force from a motor (not shown) is transmitted to the drive gear 62.

The bearings 60, 60 and the drive gear 62 are formed from a compound resin material, such as a polyphenylene sulfide resin (PPS), which serves as a matrix, dispersed with carbon, which serves as a conductive filler. Therefore, the bearings 60, 60 and the drive gear 62 have stable electrical conductivity and heat resistance of up to about 250 to 260° C. Therefore, problems such as deformation of the bearings 60, 60 and the drive gear 62 will not occur as long as the thermal roller 10 is used at a normal operation temperature of around 200° C.

The thermal roller 10 is electrically connected to, for example, a metal component connected to ground via the bearings 60, 60 or the drive gear 62 so that the thermal roller 10 can be prevented from developing a charge.

Sliding contact mechanisms 70, 70 are provided at either end of the thermal roller 10. The sliding contact mechanisms 70, 70 serve as electrodes through which an alternating current or a direct current is supplied to the sheet-shaped heating body 50. Both of the sliding contact mechanisms 70, 70 have substantially the same configuration. Therefore, configuration of the sliding contact mechanisms 70, 70 will be explained while referring only to the left hand sliding contact mechanisms 70 shown in FIG. 6 as a representative example unless otherwise stated.

The sliding contact mechanism 70 includes a rotational electrode member 71 and a stationary electrode member 72. The rotational electrode member 71 is fixed to the thermal roller 10 and so rotates integrally with the thermal roller 10. As shown in FIG. 5, the stationary electrode member 72 is attached to the frame of the laser printer P and is supported in contact with the rotational electrode member 71.

The rotational electrode member 71 is assembled from an electrode portion 74 and a holder portion 75. The electrode portion 74 is formed from a copper compound such as phosphor bronze. The holder portion 75 formed from PPS or other resin with good heat resistance.

The electrode portion 74 includes a collector plate 74*a*, positioning ribs 74*b* (only one shown) disposed on an interior surface of the collector plate 74*a*, plate spring portions 74*d* extending from the collector plate 74*a*, and contacts 74*c* connected integrally to corresponding ends of the plate spring portions 74*d*. The collector plate 74*a* serves as a contact surface of the rotational electrode member 71 and is disposed in a perpendicular orientation with respect to an imaginary rotational axis RA of the thermal roller 10.

The plate spring portions 74*d* press corresponding contacts 74*c* against the first energization terminal 55*b* of the sheet-shaped heating body 50, thereby bringing the contacts 74*c* and the first energization terminal 55*b* into electrical connection. In this way, the contacts 74*c* form contact surfaces for connecting the electrode portion 74 electrically with the thermal body 50. Further, friction is developed between the contacts 74*c* and the first energization terminal 55*b* by pressing operation of the plate spring portions 74*d*. This friction prevents the rotational electrode member 71 from rotating separately from the thermal roller 10 and falling out of the thermal roller 10.

The holder portion 75 includes a tubular portion 75*d*, protrusions 75*a*, 75*b* protruding inwardly from the tubular portion 75*d*, guide groves 75*c* (only one shown) formed in the interior of the tubular portion 75*d*, and a flange 75*e* formed around the outside of the tubular portion 75*d*.

The rotational electrode member 71 is fitted in the thermal roller 10 by inserting the tubular portion 75*d* to the inside of the sheet-shaped heating body 50 from a leftward axial end of the thermal roller 10 and moving the rotational electrode member 71 rightward to follow the imaginary rotational axis RA of the thermal roller 10. When the rotational electrode member 71 is fitted into the thermal roller 10, the flange 75*e* at the outer surface of the holder portion 75 abuts against the rim end of the thermal roller 10, so that further movement of the rotational electrode member 71 into the thermal roller 10 will be prevented beyond a certain position.

Figure 6:
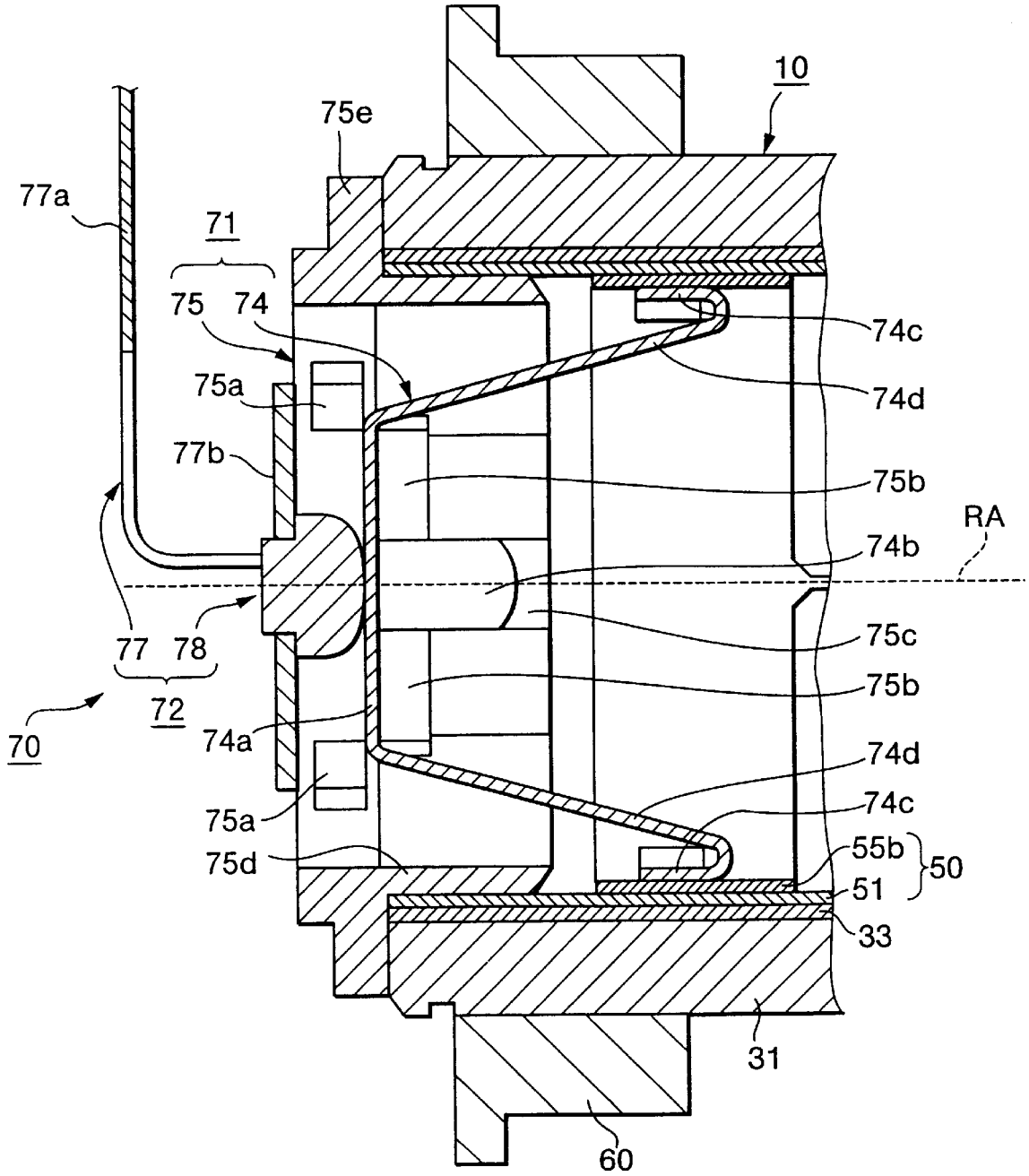
FIG. 6 is a magnified cross-sectional view of FIG. 5 showing a sliding contact mechanism having a stationary electrode member and a rotational electrode member.

Therefore, even though the stationary electrode member 72 urges the rotational electrode member 71 further into the thermal roller 10 in a direction in which the rotational axis RA of the thermal roller 10 extends, that is, to the right in FIG. 6, the rotational electrode member 71 will not move further into the thermal roller 10. Because the flange 75*e* prevents the rotational electrode member 71 from moving into the thermal roller 10, contact between the rotational electrode member 71 and the stationary electrode member 72 can be stably maintained so that the thermal roller 10 will sufficiently heat up. Further, there is no need to design the rotational electrode member 71 and the thermal roller 10 so that excessive friction is generated between the outer peripheral surface of the rotational electrode member 71 and the inner surface of the thermal roller 10 to prevent the rotational electrode member 71 from moving into the thermal roller 10. Further, operations for inserting the rotational electrode member 71 into the interior of the thermal roller 10 can be performed with great ease.

To maintain the electrode portion 74 and the holder portion 75 in a stable relative position without any displacement between the two, the electrode portion 74 is sandwiched between an inner peripheral surface of the tubular portion 75*d* and the protrusions 75*a*, 75*b*. Also the positioning ribs 74*b* are fitted in corresponding ones of the guide grooves 75*c*.

The stationary electrode member 72 includes an electric supply plate 77 formed from a copper compound such as phosphor bronze and a conductive protrusion 78 formed from a silver compound.

The electric supply plate 77 includes a resilient portion 77*a* and a pressing plate 77*b* formed integrally with each other. As shown in FIG. 5, the electric supply plate 77 is attached at the resilient portion 77*a* end to the upper cover 18, by a screw for example. The pressing plate 77*b* end is free to move with resilient deformation of the resilient portion 77*a*.

Figure 7:
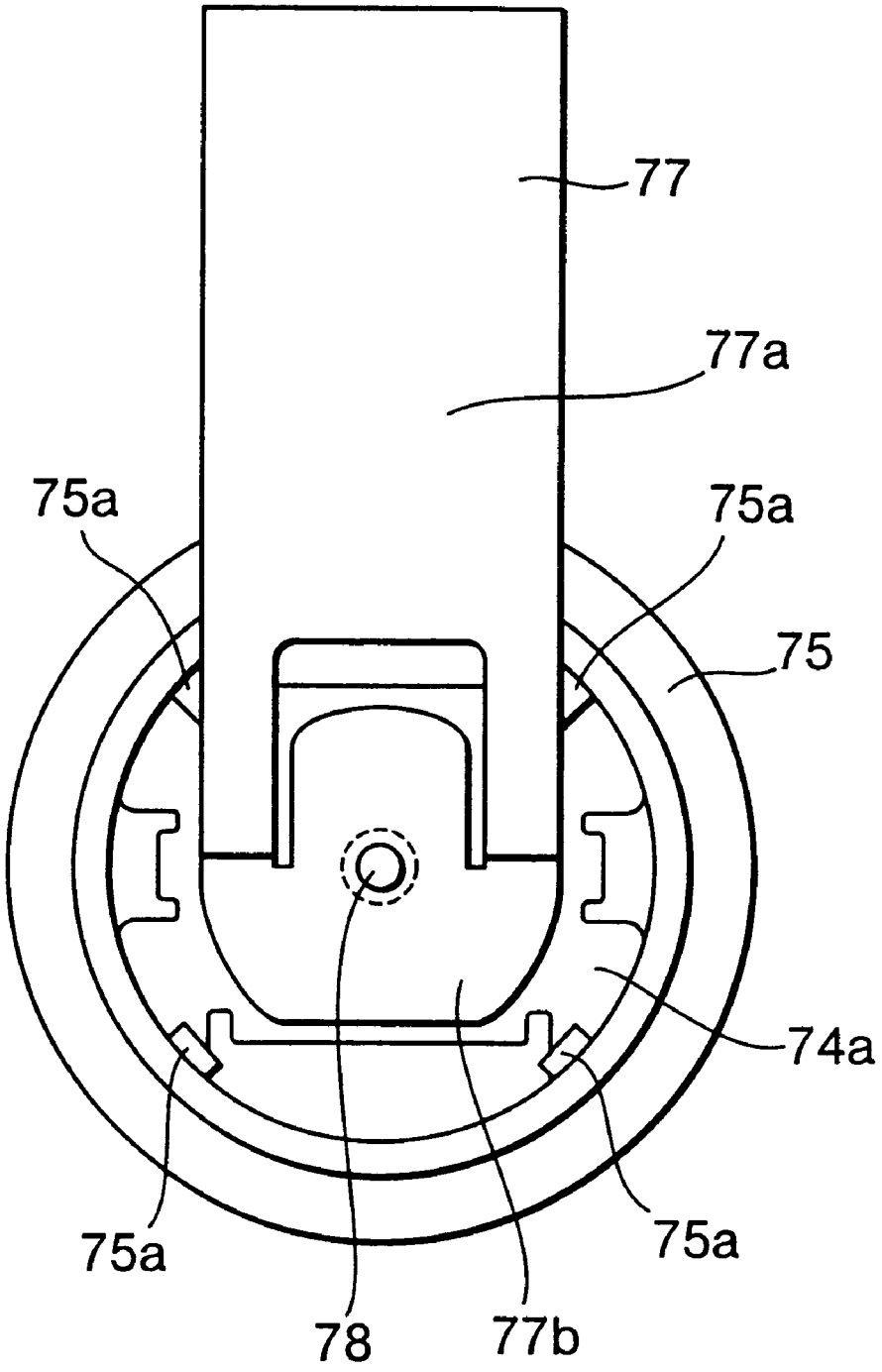
FIG. 7 is a side view showing the sliding contact mechanism of FIG. 6.

As shown in FIGS. 6 and 7, the conductive protrusion 78 is provided to the pressing plate 77*b* and is pressed by force of the resilient portion 77*a* against the rotational center of the collector plate 74*a*, that is, at the position where the collector plate 74*a* intersects the imaginary rotation axis RA. As a result, both the electric supply plate 77 and the rotational electrode member 71 are in electric contact with each other. In particular, even when the thermal roller 10 rotates, electrical contact between the electric supply plate 77 and the rotational electrode member 71 can be maintained while the two slide against each other.

The roller body 31, which serves as a base for the thermal roller 10, is formed from aluminum and so has good heat conduction. On the other hand, the holder portion 75, which is a portion of the rotational electrode member 71, is formed from an electrically insulating material. With this configuration, the electrode portion 74 and other conductive portions of the rotational electrode member 71 will not directly abut against the end surface of the roller body 31 when the rotational electrode member 71 is fitted in the roller body 31. Instead, the rotational electrode member 71 abuts against the end surface of the roller body 31 with the holder portion 75 interposed between the end surface of the roller body 31 and the electrode portion 74 and other conductive portions of the rotational electrode member 71.

Because the holder portion 75 prevents contact between the electrode portion 74 and the roller body 31, the electrode portion 74 and the roller body 31 will not become electrically connected, even though the roller body 31 is made from metal. Accordingly, problems cause by electrical leaks from the roller body 31 will not occur. For example, the thermal temperature of the sheet-shaped heating body 50 will not drop due to electrical leaks and shocks caused by contact with the thermal roller 10 will not occur.

Because the rotational electrode member 71 includes the electrode portion 74, which has good electrical conductivity, and the holder portion 75, which provides electrical insulation, the rotational electrode member 71 can be inserted into the roller body 31 without interposing a separate electrically insulating body in between the rotational electrode member 71 and the roller body 31. In other words, because the rotational electrode member 71 itself is formed from both a conductive portion (74) and an electrical insulation portion (75), by merely inserting the rotational electrode member 71 into the roller body 31, the electrical insulation portion (75) abuts against the end of the roller body 31 and is interposed between the end of the roller body 31 and the conductive portion (74) of the rotational electrode member 71.

Accordingly, operations for attaching the rotational electrode member 71 to the roller body 31 can be easily performed. Also, by merely fitting the rotational electrode member 71 into the thermal roller 10, the contacts 74*c* of the electrode portion 74 will press against the energization terminal of the sheet-shaped heating body 50 so that the sheet-shaped heating body 50 and the electrode portion 74 of the rotational electrode member 71 come into electric contact with each other. Therefore, assembly operations are trouble-free compared to conceivable configuration wherein the thermal body and the conductive portion of the rotational electrode member must be first connected before the rotational electrode member is fitted into the roller or wherein the heating body and the conductive portion of the rotational electrode member need to be connected after the rotational electrode member is fitted into the roller.

A second embodiment will be described while referring to FIG. 8. According to the second embodiment, the rotational electrode member is formed completely from a material with good electrical conduction. This contrasts with the fixing device 1 described in the first embodiment, wherein the rotational electrode member 71 is formed from the holder portion 75 and the electrode portion 74.

Figure 8:
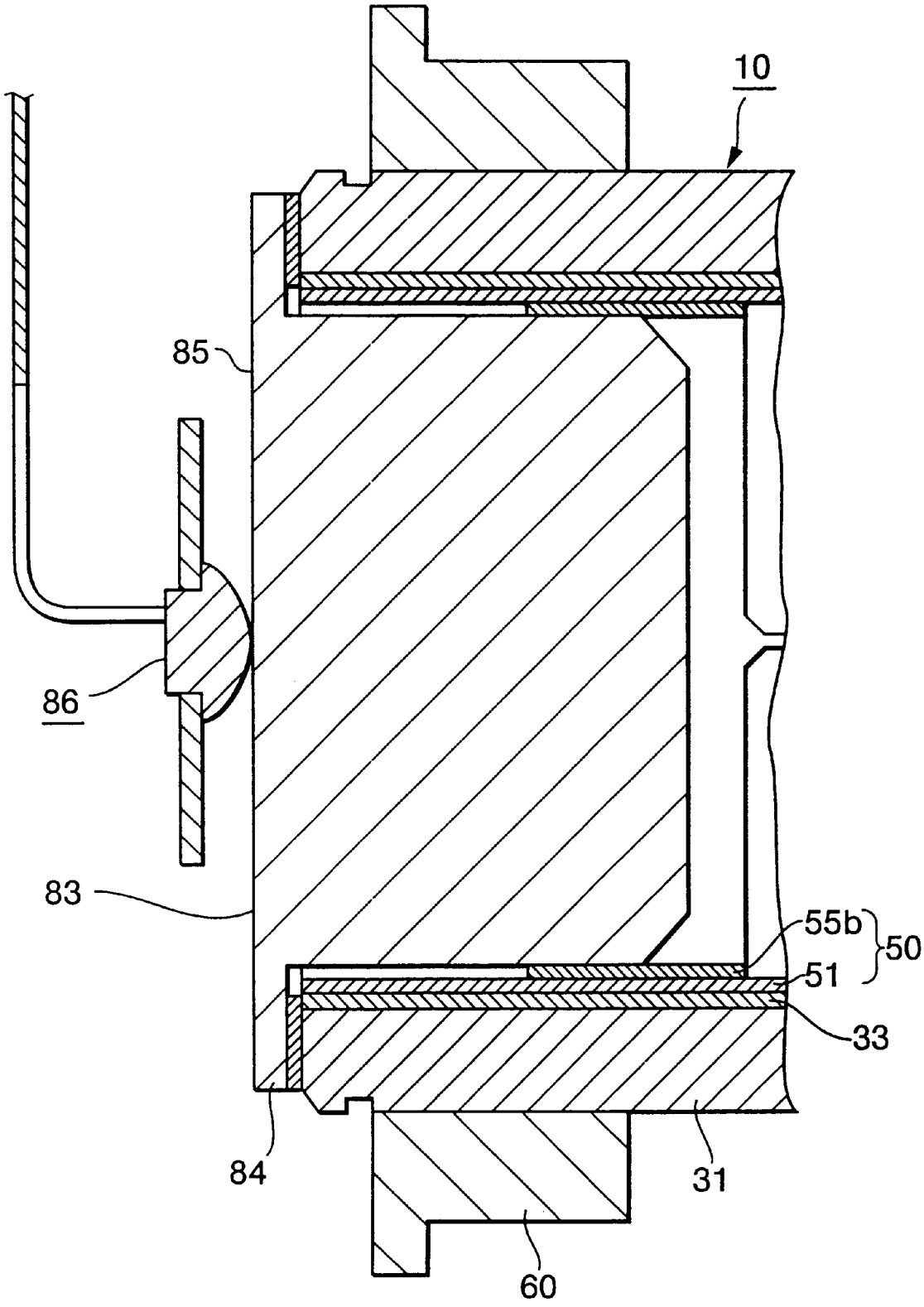
FIG. 8 is a cross sectional view showing a sliding contact mechanism according a second embodiment, wherein the rotational electrode member is formed entirely from a conductive material.

FIG. 8 shows a rotational electrode member 83 formed completely from a material with good electrical conduction. The rotational electrode member 83 includes a contact surface 85 disposed to intersect the imaginary rotational axis RA of the thermal roller 10. A flange body 84 is formed at one end of the rotational electrode member 83 around the periphery of the rotational electrode member 83.

The rotational electrode member 83 is fitted into the thermal roller 10 by being inserted from a leftward axial end of the thermal roller 10 and moved into the thermal roller 10 in a rightward axial direction of the thermal roller 10. At this time, the flange body 84 abuts against the end of the thermal roller 10 so that the rotational electrode member 83 can move no further into the thermal roller 10. With this configuration, even if a stationary electrode member 86 presses the contact surface 85 in the rightward axial direction, that is, farther into the interior of the thermal roller 10, the rotational electrode member 83 will not move further into the thermal roller 10.

However, because the rotational electrode member 83 is formed from a conductive material, there is a need to interpose an electrical insulation body between the rotational electrode member 83 and the roller body 31 to prevent them from becoming electrically connected with each other. For this reason, according to the second embodiment, the first thermal resistant layer 33 of the thermal roller 10 is formed to cover the end of the thermal roller 10, thereby preventing direct contact between the rotational electrode member 83 and the roller body 31. Alternatively, the end portion of the roller body 31 can be covered with a film of insulation material. Any configuration for providing electrical insulation to be end of the roller body 31 can be used effectively.

A third embodiment of the present invention will be described while referring to FIG. 9. According to the third embodiment, two conductive protrusions are provided to the stationary electrode member. This contrasts with the first and second embodiments, wherein the stationary electrode member 72 has only a single conductive protrusion 78 disposed to contact the rotational center of the collector plate.

Figure 9:
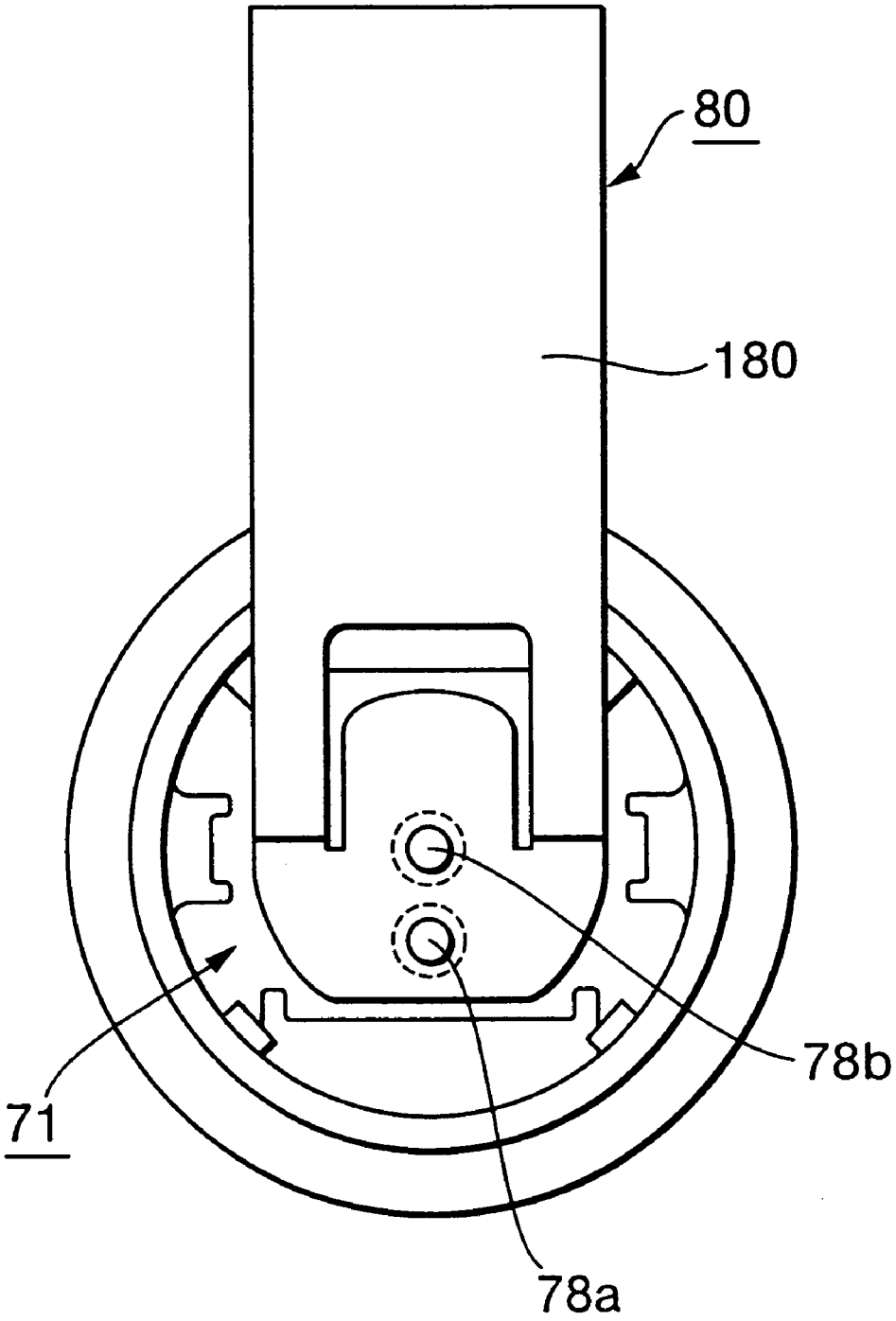
FIG. 9 is a side view showing a sliding contact mechanism according a third embodiment, wherein the stationary electrode member has a single resilient member and two conductive protrusions.

FIG. 9 shows a stationary electrode member 80 provided with two conductive protrusions 81, 82 pressed against the contact surface of the rotational electrode member by the same resilient portion 180. The conductive protrusion 81 contacts a first position at the rotational center of the collector plate 74*a* and the conductive protrusion 82 contacts a second position separated from the first position.

By configuring the device in this manner, the stationary electrode member 80 contacts the rotational electrode member 71 at the second position as well as at the first position. If electrical connection at either position is interupted for some reason, electrical connection can be maintained properly at the other contact position so that energization condition can be more stably maintained. Further, because the conductive protrusion 81 contacts the rotational electrode member 71 at the first position at the rotational center of the rotational electrode member 71, friction between the electrode members 71, 80 can be suppressed and also the burden on the rotational drive system of the thermal roller 10 can be reduced. Also, noise generated during operation can also be reduced.

Figure 10:
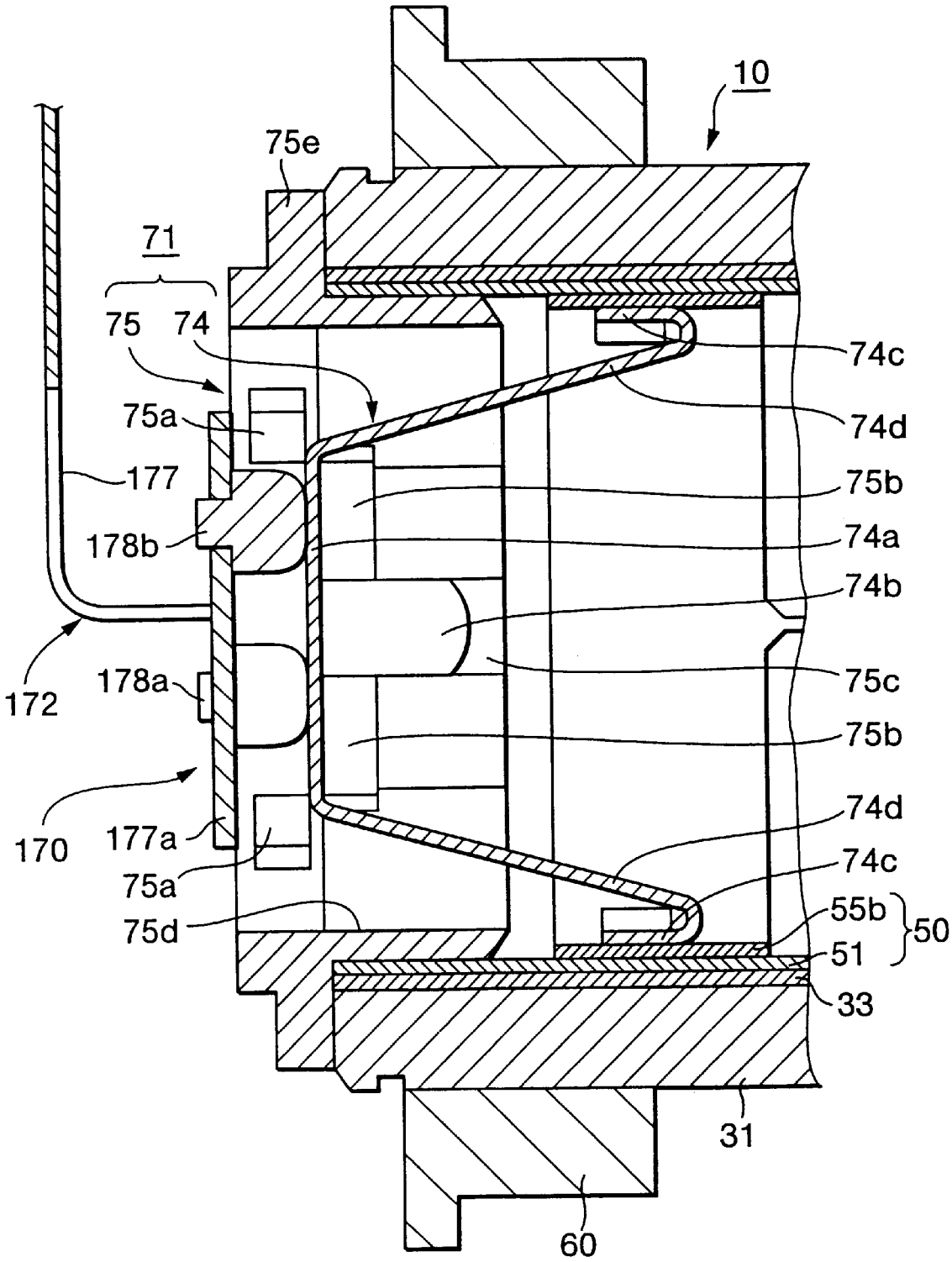
FIG. 10 is a cross-sectional view showing a sliding contact mechanism according a fourth embodiment, wherein the stationary electrode member has a single resilient member and three conductive protrusions.
Figure 11:
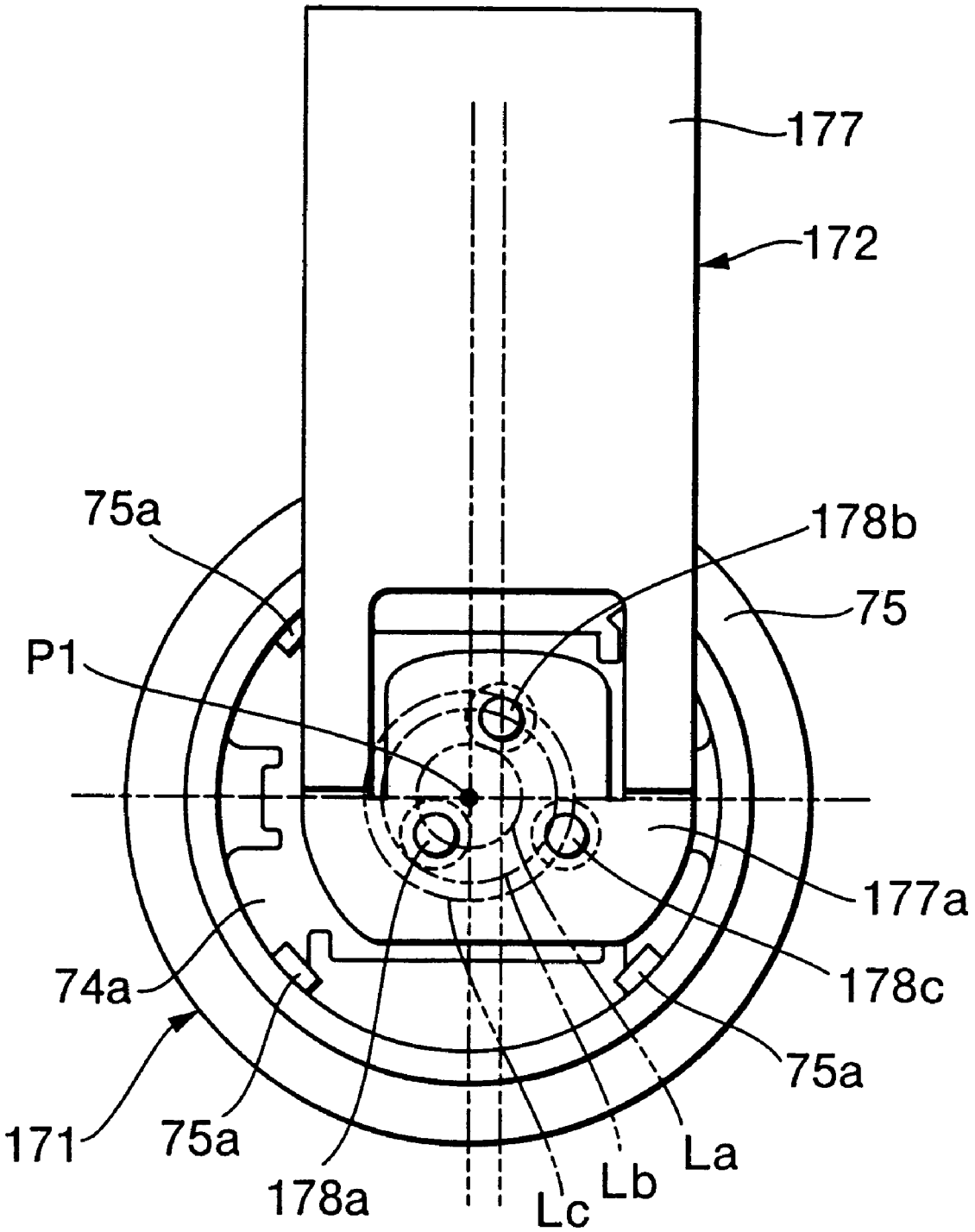
FIG. 11 is a side view showing arrangement of the conductive protrusions of the sliding contact mechanism of FIG. 10.
Figure 12:
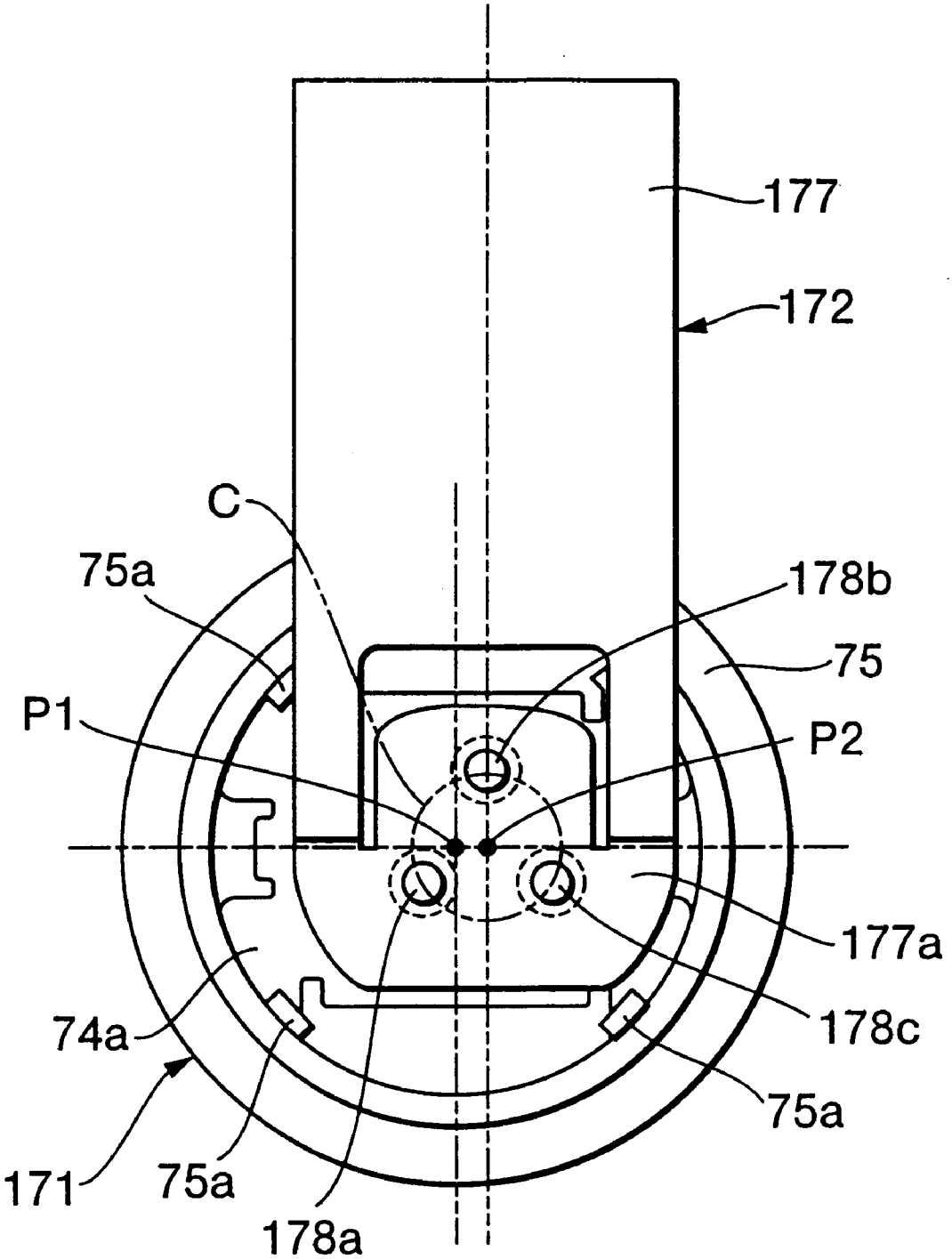
FIG. 12 is a side view showing arrangement of the conductive protrusions of the sliding contact mechanism of FIG. 10.

A fourth embodiment of the present invention will be described while referring to FIGS. 10 to 12. According to the fourth embodiment, the stationary electrode member is provided with three conductive protrusions instead of only one or two. FIGS. 10 to 12 show a stationary electrode member 172 including an electric supply plate 177, a support plate 177*a*, and three conductive protrusions 178*a* to 178*c*. The support plate 177*a* is formed at the free tip of the electric supply plate 177 and is supported in a parallel orientation with the collector plate 74*a*. The three conductive protrusions 178*a* to 178*c* are fixed on the support plate 177*a*.

The electric supply plate 177 resiliently presses the three conductive protrusions 178*a* to 178*c* against the collector plate 74*a* of the rotational electrode member 71, thereby bringing the rotational electrode member 71 and the stationary electrode member 172 into electric connection with each other where the conductive protrusions 178*a* to 178*c* pressingly contact the collector plate 74*a*. Electric connection between the two electrode members is maintained by the stationary electrode member 172 and the rotational electrode member 71 sliding against each other, even when the rotational electrode member 71 rotates.

As shown in FIG. 11, the conductive protrusions 178*a* to 178*c* contact the collector plate 74*a* of the rotational electrode member 71 at positions separated by different distances from the rotational center P1 of the rotational electrode member 71. For this reason, when the rotational electrode member 71 rotates, the conductive protrusions 178*a* to 178*c* delineate, or draw, concentric orbits 7*a* to 7*c* on the collector plate 74*a*. Because the orbits 7*a* to 7*c* are concentric, and so do not overlap, no two of the conductive protrusions 178*a* to 178*c* abrade against the same portion on the collector plate 74*a*. Therefore, localized wear of the rotational electrode member 71 can be suppressed.

Said differently, as shown in FIG. 12, the conductive protrusions 178*a* to 178*c* are arranged on the support plate 177*a* on the same circle C, wherein the center P2 of the circle C is positioned so as not to overlap the rotational center P1 of the rotational electrode member 71. As described above, the conductive protrusions 178*a* to 178*c* contact the collector plate 74*a* at positions separated by different distances from the rotational center P1 of the rotational electrode member 71. When the conductive protrusions 178*a* to 178*c* are arranged on the same circle C on the support plate 177*a* in this manner, pressing force from the electric supply plate 177 is uniformly dispersed among the conductive protrusions 178*a* to 178*c*. Therefore, no particular conductive protrusion will wear down more than the others.

Two sliding contact mechanisms each having a stationary electrode member 172 are provided for supplying power to the thermal roller 10. That is, one sliding contact mechanism is provided at each end of the thermal roller 10. In other words, the two sliding contact mechanisms serve as terminals for supplying an alternating current or a direct current power to the sheet-shaped heating body 50. Because the plurality of conductive protrusions 178*a* to 178*c* contact the collector plate 74*a* at a plurality of different locations, if for some reason electrical connection becomes defective at one of the conductive protrusions 178*a* to 178*c*, electrical connection can be maintained by the remainder of the conductive protrusions 178*a* to 178*c* so that stable supply of power can be maintained. Furthermore, because the plurality of conductive protrusions 178*a* to 178*c* draw concentric orbits La to Lc on the collector plate 74*a*, even though the number of conductive protrusions has been increased, different conductive protrusions will not pass across the same location of the rotational electrode member 71 so that excessive wear can be prevented. Accordingly, the rotational electrode member 71 will not be locally worn down and its life span can be increased.

Because the plurality of conductive protrusions 178*a* to 178*c* are positioned on the same circle C on the support plate 177*a*, contact between the conductive protrusions 178*a* to 178*c* and the rotational electrode member 71 is uniform so that excessive wear of any particular conductive protrusion can be avoided. Although desirable, the conductive protrusions need not be arranged on the same circle as long as at least two are arranged to draw different orbits on the contact of the rotational electrode member.

Here, a fifth embodiment of the present invention will be described while referring to FIGS. 13 and 14. According to the fifth embodiment, the stationary electrode member is provided with five conductive protrusions. That is, although examples were given of the stationary electrode member being provided with one, two, and three conductive protrusions, more than three can be provided. In other words, the stationary electrode member can be provided with any number of conductive protrusions.

Figure 13:
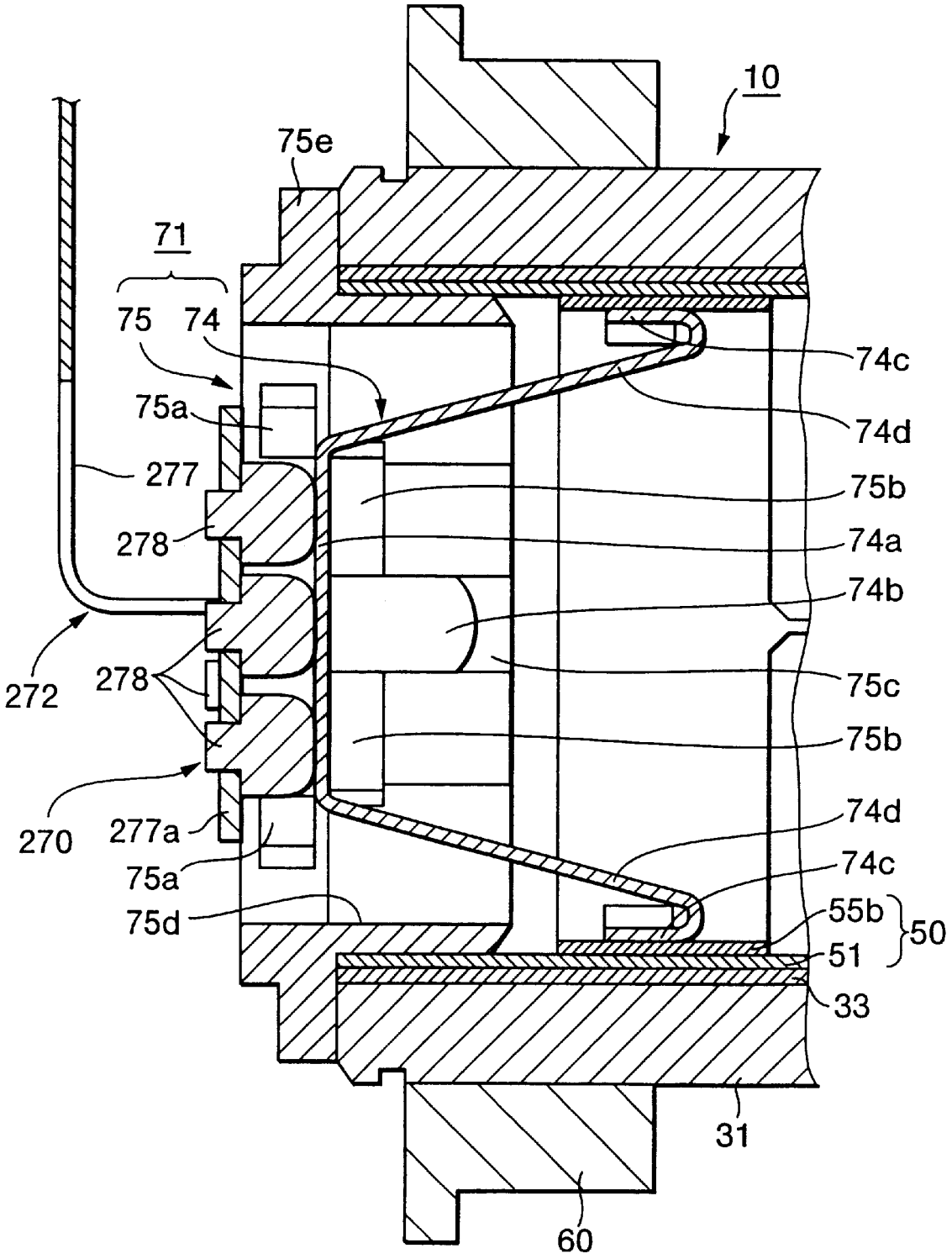
FIG. 13 is a cross-sectional view showing a sliding contact mechanism according a fifth embodiment, wherein the stationary electrode member has a single resilient member and five conductive protrusions.
Figure 14:
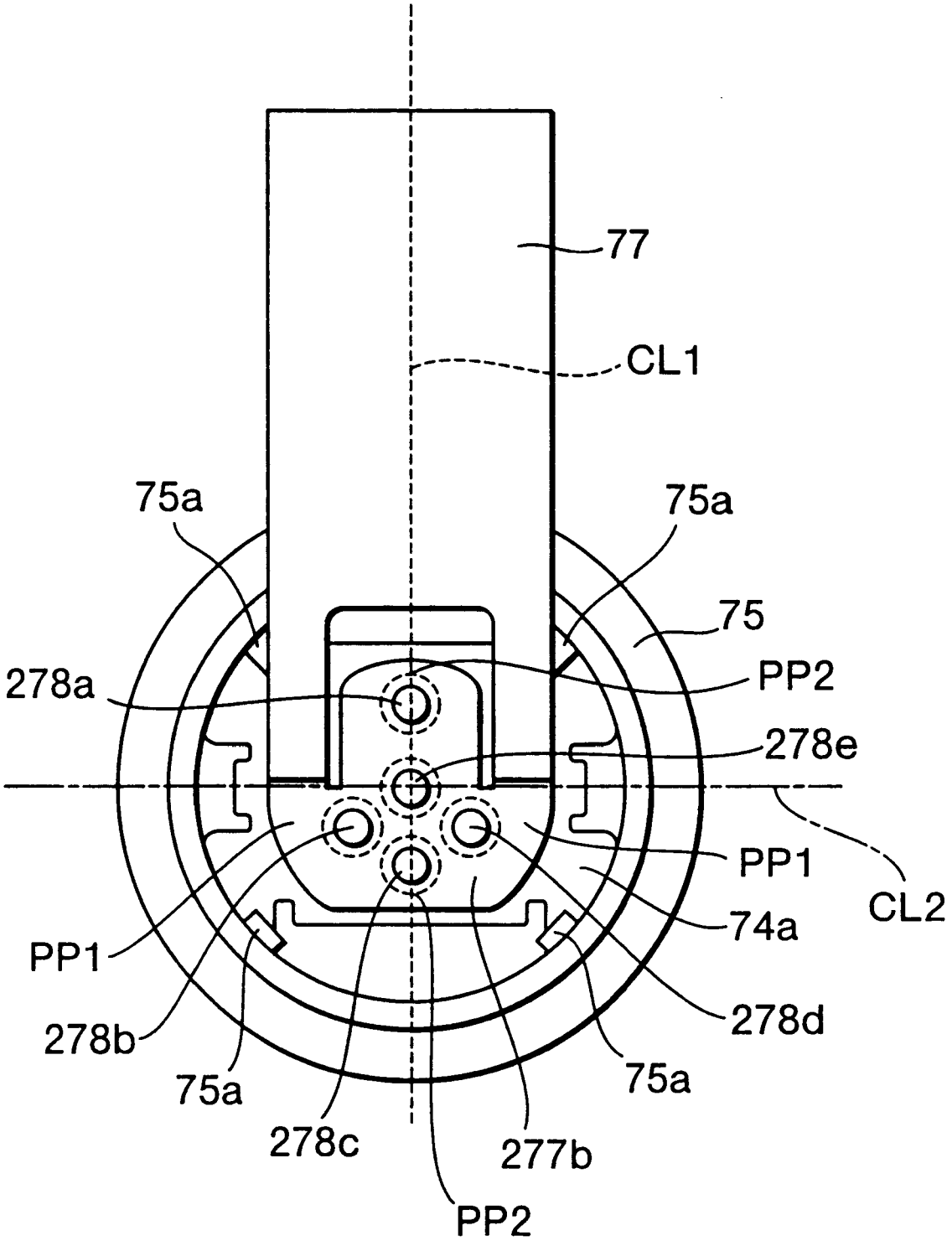
FIG. 14 is a side view showing the sliding contact mechanism of FIG. 13, wherein the conductive protrusions are arranged to prevent undesirable moment from being generated by the resilient member.

FIGS. 13 and 14 show a stationary electrode member 272 including an electric supply plate 277, a support plate 277*a*, and five conductive protrusions 278*a* to 278*e*. The support plate 277*a* is provided to the free end of the electric supply plate 277 and is supported in a parallel condition with the collector plate 74*a*. The five conductive protrusions 278*a* to 278*e* are fixed to the support plate 277*a*.

The electric supply plate 277 resiliently presses the five conductive protrusions 278*a* to 278*e* against the collector plate 74*a*, thereby bringing the rotational electrode member 71 and the stationary electrode member 272 into electric connection with each other where the conductive protrusions 278*a* to 278*e* pressingly contact the collector plate 74*a*. Electric connection between the two electrode members is maintained by the stationary electrode member 272 and the rotational electrode member 71 sliding against each other, even when the rotational electrode member 71 rotates.

The conductive protrusions 278*a* to 278*e* are arranged to disperse pressing force of the electric supply plate 277. In particular, the conductive protrusions 278*a* to 278*e* are arranged at positions to prevent generation of pivotal moment that pivots the support plate 277*a* in a direction for separating the remainder of the conductive protrusions 278*a* to 278*e* from the rotational electrode member 71 by one of the conductive protrusions 278*a* to 278*e* acting as a fulcrum. Therefore, even if the support plate 277*a* generates a large pressing force, none of the conductive protrusions 278*a* to 278*e* will lift away from the contact surface 74*a* by some of the conductive protrusions 278*a* to 278*e* acting as a fulcrum. As a result, two or more of the conductive protrusions 278*a* to 278*e* can be maintained in contact the contact surface 74*a* without precisely adjusting the pressing force generated by the support plate 277*a*.

To prevent pivotal moment of the support plate 277*a* in this manner, the five conductive protrusions 278*a* to 278*e* according to the present embodiment are positioned in a linear symmetric relationship with respect to an imaginary center lines CL1 and CL2: the conductive protrusions 278*b* and 278*d* being in a linear symmetric relationship with the imaginary center line CL1, and the conductive protrusions 278*a*, 278*c*, and 278*e* being in a linear symmetric relationship with the imaginary center line CL2. Further, the electric supply plate 277 is formed and supported to apply pressing force on the support plate 277*a* at pressing positions separated farther from the imaginary center line CL1, CL2 than the five conductive protrusions 278*a* to 278*e*. That is, the electric supply plate 277 is formed and supported to apply pressing force on the support plate 277*a* at pressing positions PP1, which are separated farther from the imaginary center line CL1 than the conductive protrusions 278*b* and 278*d*, and at pressing positions PP2, which are separated farther from the imaginary center line CL2 than the conductive protrusions 278*a*, 278*c*, and 278*e*.

As a result, the support plate 277*a* will not rotate. Therefore, all five of the conductive protrusions 278*a* to 278*e* will press in contact with the rotational electrode member 71. For this reason, load will not be concentrated excessively on any particular conductive protrusions 278*a* to 278*e*. Even if pressing force of the electric supply plate 277 is relatively large, the support plate 277*a* will not twist. Therefore, no certain conductive protrusion 78 will lift off the rotational electrode member 71. Accordingly, no particular conductive protrusion 78 will be worn out more than the others. Defective contact will not occur.

A sixth embodiment will be described while referring to FIGS. 15 and 16. According to the sixth embodiment, more than one resilient member is provided for pressing the conductive protrusions against the contact surface of the rotational electrode member. For example, although the fourth embodiment of FIGS. 10 to 12 indicates a single resilient member for three conductive protrusions, more than one resilient member can be provided for each one or more conductive protrusions.

Figure 15:
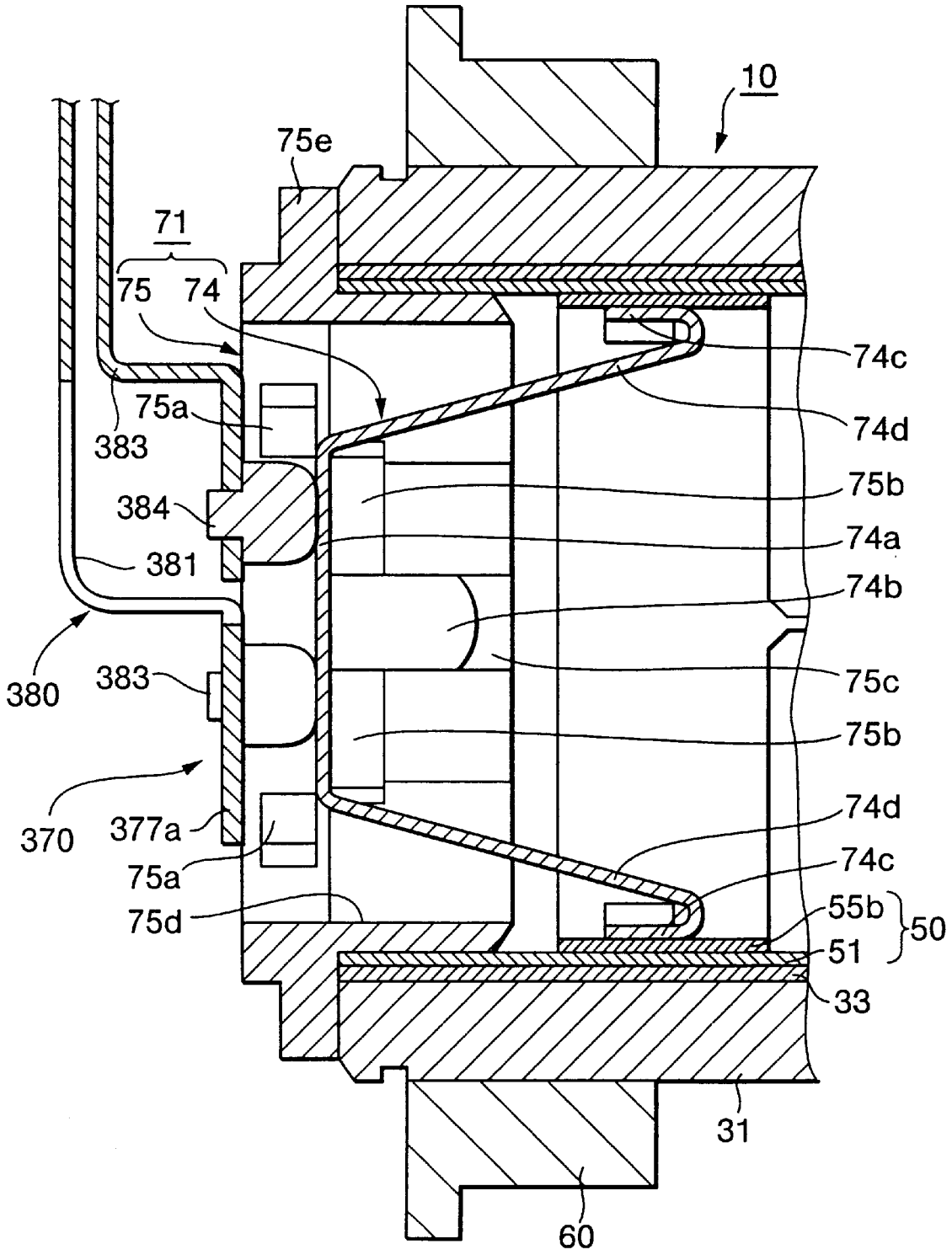
FIG. 15 is a cross-sectional view showing a sliding contact mechanism according a sixth embodiment, wherein the stationary electrode member has a plurality of resilient members and at least one conductive protrusion for each resilient member.
Figure 16:
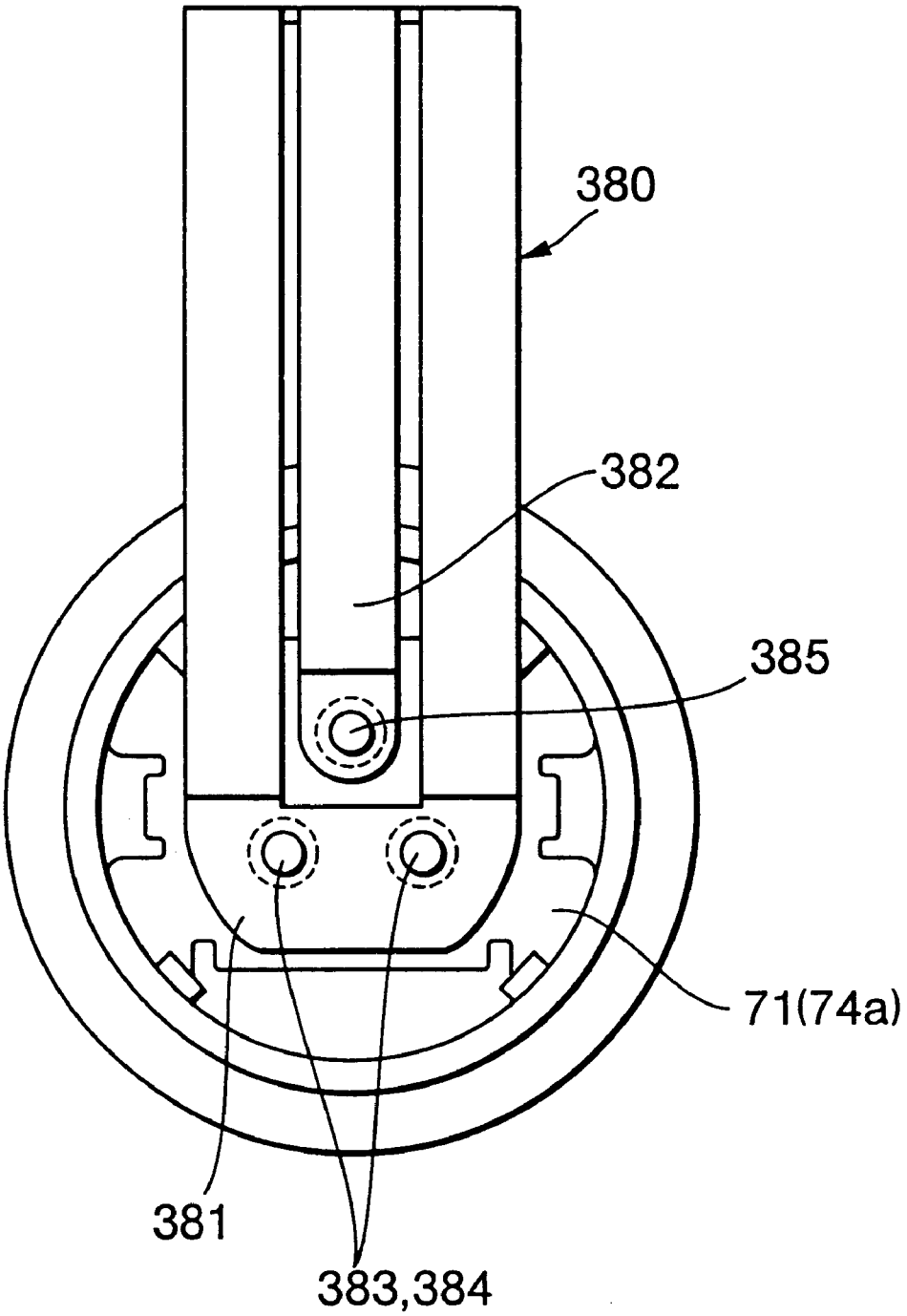
FIG. 16 is a side view showing arrangement of the resilient members and conductive protrusions of the sliding contact mechanism of FIG. 15.

As shown in FIGS. 15 and 16, a stationary electrode member 380 includes a resiliently deformable first and second power supply plates 381, 382 and conductive protrusions 383, 384, 385. The first and second power supply plates 381, 382 are provided integrally with each other at their fixed ends, but separated from each other at their free ends. In other words, each of the free ends functions independently in the manner of a plate spring as described for the electric supply plate 77.

The conductive protrusions 383, 384 are fixed to the first power supply plate 381 and the conductive protrusion 385 is fixed on the second power supply plate 382. With this configuration, the first and second power supply plates 381, 382 press the conductive protrusions 383, 384 against the contact surface 74*a* of the rotational electrode member 71.

The first power supply plate 381 and the conductive protrusions 383, 384 operate together in the same manner as the above-described stationary electrode member 372, and therefore achieves the same effects as the stationary electrode member 372. In addition, the first and second power supply plates 381, 382 independently press conductive protrusions 383, 384, 385 into contact with the rotational electrode member 71. Therefore, even if the conductive protrusions of one of the power supply plates 381 or 382 does not properly contact the contact surface 74*a* of the rotational electrode member 71, the conductive protrusions of the other supply plate 381 or 382 will be unaffected by this force and so will maintain proper contact with the rotational electrode member 71 via its conductive protrusions.

The embodiments shown in FIGS. 9, 11, 12, 14, and 16 describe fixing devices wherein 1) two or more contact points are provided on a single resilient body and 2) the contact surface of the rotational electrode member is approximately perpendicular to an imaginary rotational axis of the roller. However, a fixing device need not be provided with both of these features.

Figure 17:
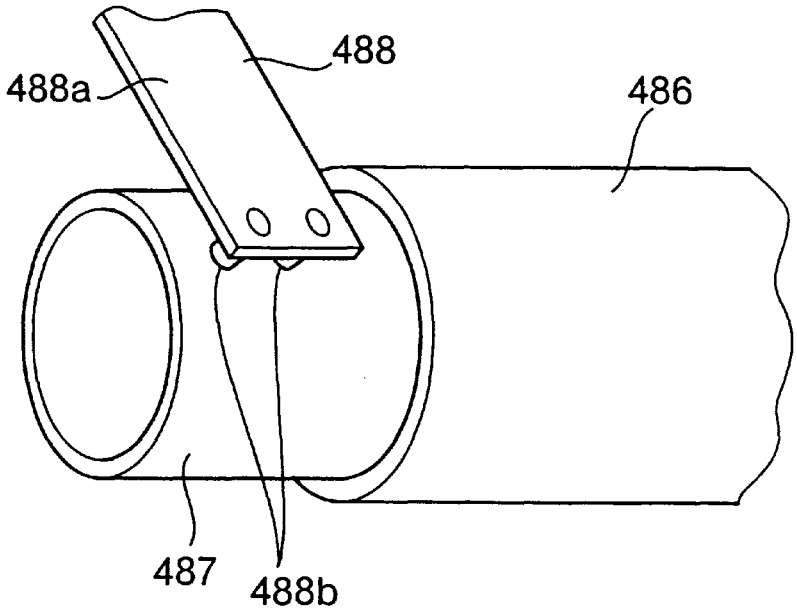
FIG. 17 is a partial perspective view showing a sliding contact mechanism according to an eight embodiment of the present invention.

FIG. 17 shows a fixing device according to an eighth embodiment including only feature 1) above. A cylindrical rotational electrode member 487 is provided at an end of the thermal roller 486. A stationary electrode member 488 is provided to contact the outer peripheral surface of the rotational electrode member 487. The stationary electrode member 488 is configured from a single resilient power supply plate 488*a*, and two conductive protrusion 488*b* fixed on the support plate 488*a*. The two conductive protrusions 488*b* are pressed into contact with the rotational electrode member 487 at two contact positions relatively separated from each other by a predetermined amount in the direction in which the imaginary rotational axis of the roller extends. Because of this, the two contact points do not draw orbits at the same positions on the rotational electrode member when the rotational electrode member rotates.

However, with this configuration the conductive protrusions 488*b* contact rotational electrode member 487 at a position relatively remote from the imaginary rotational axis of the thermal roller 486, thereby by increasing sliding speed and sliding distance. It is therefore desirable to configure the fixing device to also include the feature 2) to prevent friction, vibration, and noise generated at the conductive protrusions. It should be noted that more than two protrusions 488*b* could be provided to the power supply plate 488*a*.

Figure 18:
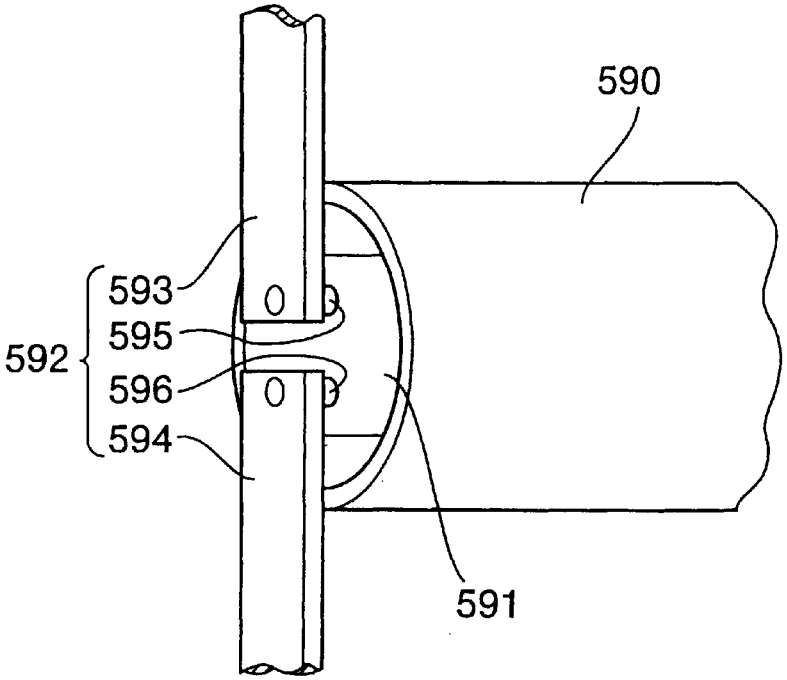
FIG. 18 is a partial perspective view showing a sliding contact mechanism according to a ninth embodiment of the present invention.

FIG. 18 shows a fixing device according to a ninth embodiment including only feature 2). A rotational electrode member 591 having a contact surface substantially perpendicular with an imaginary rotational axis of a thermal roller 590 is provided at one end of a thermal roller 590. A stationary electrode member 592 is formed from two power supply plates 593, 594. A conductive protrusion 595 is fixed to the power supply plate 593 and a conductive protrusion 596 is fixed to the power supply plate 594. In other words, resilient bodies are provided in the same number as the number of contact points. With this configuration, the power supply plates 593, 594 press the conductive protrusions 595, 596 against the rotational electrode member 591. However, this configuration requires a large space for arranging the resilient bodies. Also, it is not always easy to bring the stationary electrode member into contact with the rotational center of the contact surface of the rotational electrode member. Therefore, noise and vibration and heavy load on the roller drive system and the contact points may become a problem.

Further, although the fixing device 1 is described in the embodiment as being disposed in the laser printer P, the fixing device 1 can be used in any image forming device that includes an image forming mechanism that forms images by impinging thermally meltable recording material onto a recording medium, such as a paper sheet. For example, the fixing device 1 can be used in copiers, printers, or facsimile machines to fix images formed by the image forming mechanism onto the recording medium.

With the exception of the eight embodiment, the embodiments describe the collector plate of the rotational electrode member as being supported in an orientation perpendicular with the imaginary rotational axis of the thermal roller. However, the contact surface of the rotational electrode member need not be disposed perpendicular with the imaginary rotational axis RA of the thermal roller. The contact surface of the rotational electrode member can alternatively merely intersect the imaginary rotational axis of the thermal roller, as long as the contact surface is disposed within a range that the free end of the stationary electrode member can properly follow, so that electrically connection between the rotational and stationary electrode members can be maintained. However, it is best to orient the contact surface of the rotational electrode member in a perpendicular orientation with respect to the imaginary rotational axis of the thermal roller, because this configuration places a lower burden on the stationary electrode member.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A fixing device for heating a recording material on a recording medium to fix the recording material onto the recording medium, the fixing device comprising:

a roller rotatably supported about an imaginary rotational axis;

a heating body fixed on the roller, the heating body heating up when energized with electric power; and a sliding contact point mechanism for supplying power to the heating body for energizing the heating body, the sliding contact point mechanism including:

a rotational electrode member fixed to the roller so as to rotate integrally with the roller, the rotational electrode member having a contact surface that intersects the imaginary rotational axis; and a stationary electrode member disposed in sliding contact with the contact surface of the rotational electrode member.

2. A fixing device as claimed in claim 1, wherein the stationary electrode member contacts the contact surface of the rotational electrode member at substantially where the contact surface intersects the imaginary rotational axis.

3. A fixing device as claimed in claim 1, wherein the contact surface is oriented substantially perpendicular with the imaginary rotational axis.

4. A fixing device as claimed in claim 1, wherein the roller has opposite first and second ends corresponding to opposite first and second axial directions of the imaginary rotational axis, the rotational electrode member being disposed at the first end of the roller, the stationary electrode member resiliently pressing against the contact surface in the second axial direction, the sliding contact point mechanism further including:

a positioning member for restricting movement of the rotational electrode member in the second axial direction in order to position the rotational electrode member with respect to the first end of the roller.

5. A fixing device as claimed in claim 4, wherein the roller is formed from a conductive metal and further comprising:

an insulation portion for preventing electrical connection between the roller and the rotational electrode member, the insulation portion being disposed between the roller and the rotational electrode member.

6. A fixing device as claimed in claim 5, wherein the contact surface of the rotational electrode member is formed from a conductive material and the insulation portion abuts against the first end of the roller to function as the positioning member.

7. A fixing device as claimed in claim 4, wherein:

the heating body includes an energization terminal; and the rotational electrode member has a connection portion in electrical connection with the energization terminal of the heating body at a position determined by the positioning member.

8. A fixing device as claimed in claim 1, wherein the stationary electrode member includes at least two contact points in electrical connection with the contact surface of the rotational electrode member at different positions.

9. A fixing device as claimed in claim 8, wherein one of the at least two contact points contacts the contact surface of the rotational electrode member at substantially where the contact surface intersects with the imaginary rotational axis.

10. A fixing device as claimed in claim 9, wherein the at least two contact points are arranged with respect to the contact surface so that when the rotational electrode member rotates with rotation of the roller, the at least two contact points draw different orbits on the contact surface.

11. A fixing device as claimed in claim 8, wherein the at least two contact points are disposed at positions separated from a rotational center of the rotational electrode member by different distances.

12. A fixing device as claimed in claim 11, wherein the at least two contact points are configured from conductive protrusions made from conductive material, the conductive protrusions being positioned on the same imaginary circle with a center in a non-overlapping condition with the imaginary rotational axis.

13. A fixing device as claimed in claim 8, wherein the stationary electrode member includes a resilient body for pressing the at least two contact points against the contact surface of the rotational electrode member.

14. A fixing device as claimed in claim 13, wherein the at least two contact points are protrusions formed from conductive material and are arranged so that pressing force of the resilient body is dispersed between the at least two contact points.

15. A fixing device as claimed in claim 14, wherein the stationary electrode member includes a base member pressed toward the rotational electrode member by pressing force of the resilient body, the at least two contact points being arranged on the base member in a manner for preventing pivotal moment from being generated at the base member, thereby preventing the base member from pivoting in a direction wherein one contact point serves as a fulcrum and another contact point separates from the contact surface of the rotational electrode member.

16. A fixing device as claimed in claim 15, wherein the at least two contact points are positioned on the base member in a linear symmetric relationship with respect to an imaginary center line, the resilient body pressing the base member at pressing positions separated farther from the imaginary center line than the at least two contact points.

17. A fixing device as claimed in claim 15, wherein the at least two contact points are arranged on an imaginary circle on the base member.

18. A fixing device as claimed in claim 8, wherein the stationary electrode member includes at least two resilient bodies, each resilient body separately pressing a corresponding at least one of the at least two contact points against the contact surface of the rotational electrode member.

19. A fixing device as claimed in claim 1, wherein the stationary electrode member includes a resilient body for pressing at least one of the at least two contact points against the contact surface of the rotational electrode member.

20. A fixing device as claimed in claim 1, wherein the rotational electrode member is disposed within the roller.

21. A fixing device as claimed in claim 20, wherein the roller has opposite first and second ends corresponding to opposite first and second axial directions of the imaginary rotational axis, the rotational electrode member being disposed at the first end of the roller, the stationary electrode member resiliently pressing against the contact surface in the second axial direction, the sliding contact point mechanism further including:

a positioning member for restricting movement of the rotational electrode member in the second axial direction in order to position the rotational electrode member with respect to the first end of the roller.

22. A fixing device as claimed in claim 1, further comprising a support framework for rotatably supporting the roller.

* * * * *